US011970296B2

(12) United States Patent
Bison

(10) Patent No.: US 11,970,296 B2
(45) Date of Patent: Apr. 30, 2024

(54) PALLET WRAPPING SYSTEM WITH OVERLAPPING BANDS

(71) Applicant: Darrel Bison, Phoenix, AZ (US)

(72) Inventor: Darrel Bison, Phoenix, AZ (US)

( * ) Notice: Subject to any disclaimer, the term of this patent is extended or adjusted under 35 U.S.C. 154(b) by 0 days.

(21) Appl. No.: 18/205,474

(22) Filed: Jun. 2, 2023

(65) Prior Publication Data

US 2023/0312149 A1 Oct. 5, 2023

Related U.S. Application Data

(63) Continuation of application No. 17/681,603, filed on Feb. 25, 2022, now Pat. No. 11,685,562, which is a continuation-in-part of application No. 17/570,258, filed on Jan. 6, 2022, now Pat. No. 11,801,953, and a continuation-in-part of application No. 17/568,603, filed on Jan. 4, 2022, now Pat. No. 11,628,959, which is a continuation-in-part of application No. 17/222,843, filed on Apr. 5, 2021, now Pat. No. 11,434,029.

(Continued)

(51) Int. Cl.

| | |
|---|---|
| ***B65B 11/02*** | (2006.01) |
| ***B65B 11/58*** | (2006.01) |
| *B65B 11/00* | (2006.01) |

(52) U.S. Cl.

CPC ..... *B65B 11/58* (2013.01); *B65B 11/02* (2013.01); *B65B 2011/002* (2013.01); *B65B 2210/14* (2013.01)

(58) Field of Classification Search

USPC ..... 53/399

See application file for complete search history.

(56) References Cited

U.S. PATENT DOCUMENTS

| | | | |
|---|---|---|---|
| 1,109,461 | A | 9/1914 | Price |
| 1,351,809 | A | 9/1920 | Sutherland |

(Continued)

FOREIGN PATENT DOCUMENTS

| | | |
|---|---|---|
| DE | 3933952 C1 | 5/1990 |
| DE | 19505240 | 3/1996 |

(Continued)

OTHER PUBLICATIONS

JPO machine translation of JP 10-129609 A, Aug. 14, 2013, 4 pages.

(Continued)

*Primary Examiner* — Chinyere J Rushing-Tucker

(74) *Attorney, Agent, or Firm* — Booth Udall Fuller, PLC; Kenneth C. Booth

(57) ABSTRACT

A pallet wrapping system with at least two guides sets configured to narrow the width of stretch film to form a banded edge on the stretch film. A plurality of rollers is positioned adjacent to the plurality of guides to facilitate passing the stretch film through the plurality of guides. A first roll of stretch film positioned to pass stretch film to the first set of guides, and a second roll of stretch film positioned to receive banded stretch film from the first set of guides, layer the banded stretch film onto unhanded stretch film to form an unbanded composite stretch film, and then pass the unhanded composite stretch film to the second set of guides to form a banded composite stretch film having a banded first ply with a width equal to the first width and a banded second ply with a width equal to the second width.

20 Claims, 28 Drawing Sheets

Related U.S. Application Data

(60) Provisional application No. 63/153,880, filed on Feb. 25, 2021, provisional application No. 63/004,651, filed on Apr. 3, 2020.

(56) References Cited

U.S. PATENT DOCUMENTS

| | | | |
|---|---|---|---|
| 2,026,282 | A | 12/1935 | Leguillon |
| 2,823,530 | A | 2/1958 | Rikard |
| 3,019,573 | A | 2/1962 | Navikas |
| 3,793,798 | A | 2/1974 | Lancaster |
| 3,896,604 | A | 7/1975 | Marantz |
| 4,102,513 | A | 7/1978 | Guard |
| 4,166,589 | A | 9/1979 | Hoover |
| 4,172,608 | A | 10/1979 | Brown, Jr. |
| 4,235,062 | A | 11/1980 | Lancaster, III |
| 4,255,918 | A | 3/1981 | Lancaster |
| 4,353,515 | A | 10/1982 | Weaver |
| 4,369,614 | A | 1/1983 | Tetzner |
| 4,409,776 | A | 10/1983 | Usui |
| 4,468,922 | A | 9/1984 | McCrady |
| 4,530,473 | A | 7/1985 | Parry |
| 4,619,102 | A | 10/1986 | Geisinger |
| 4,671,043 | A | 6/1987 | Forni |
| 4,723,393 | A | 2/1988 | Silbernagel |
| 4,739,945 | A | 4/1988 | Yokoe |
| 4,754,594 | A | 7/1988 | Lancaster |
| 4,807,427 | A | 2/1989 | Casteel |
| 4,827,700 | A | 5/1989 | Rampe |
| 4,845,920 | A | 7/1989 | Lancaster |
| 4,905,448 | A | 3/1990 | Plitt |
| 4,905,451 | A | 3/1990 | Jaconelli |
| 4,961,306 | A | 10/1990 | Sawhney |
| 5,031,771 | A | 7/1991 | Lancaster |
| 5,079,898 | A | 1/1992 | Springs |
| 5,107,657 | A | 4/1992 | Diehl |
| 5,125,209 | A | 6/1992 | Thimon |
| 5,168,685 | A | 12/1992 | Suzuki |
| 5,195,297 | A | 3/1993 | Lancaster |
| 5,203,939 | A | 4/1993 | Sperling |
| 5,211,353 | A | 5/1993 | Lewin |
| 5,307,609 | A | 5/1994 | Kurata |
| 5,315,808 | A | 5/1994 | MacIvor |
| 5,358,594 | A | 10/1994 | Darrieux |
| 5,385,001 | A | 1/1995 | Ramer |
| 5,409,177 | A | 4/1995 | Parry |
| 5,447,009 | A | 9/1995 | Oleksy |
| 5,535,962 | A | 7/1996 | Bargowski |
| 5,561,971 | A | 10/1996 | Sampson |
| 5,653,293 | A | 8/1997 | Ellis |
| 5,797,246 | A | 8/1998 | Martin-Cocher |
| 5,819,503 | A | 10/1998 | Lancaster, III |
| 5,965,262 | A | 10/1999 | Whisler |
| 6,065,269 | A | 5/2000 | Malnati |
| 6,102,313 | A | 8/2000 | Salzsauler |
| 6,164,047 | A | 12/2000 | Rossi |
| 6,311,459 | B1 | 11/2001 | Rossi |
| 6,393,808 | B1 | 5/2002 | Kallner |
| 6,688,076 | B1 | 2/2004 | Rivera, Jr. |
| 6,745,544 | B2 | 6/2004 | Matsumoto |
| 6,775,956 | B1 | 8/2004 | Lacey |
| 6,796,105 | B2 | 9/2004 | Rossi |
| 6,883,298 | B2 | 4/2005 | Gooding |
| 6,892,515 | B2 | 5/2005 | Cere |
| 6,971,220 | B1 | 12/2005 | Rampp |
| 7,029,206 | B2 | 4/2006 | Stockstill |
| 7,269,935 | B2 | 9/2007 | Jafari |
| 7,581,368 | B1 | 9/2009 | Bison |
| 7,621,107 | B2 | 11/2009 | Vanderheiden |
| 7,908,831 | B1 | 3/2011 | Dugan |
| 8,046,975 | B1 | 11/2011 | Bison |
| 8,053,056 | B2 | 11/2011 | Heikaus |
| 8,276,349 | B2 | 10/2012 | Van Amstel |
| 8,528,615 | B2 | 9/2013 | Colson |
| 8,549,819 | B1 | 10/2013 | Bison |
| 8,637,134 | B1 | 1/2014 | Aronsen |
| 8,707,664 | B1 | 4/2014 | Bison |
| 8,984,848 | B2 | 3/2015 | Bison |
| 9,254,931 | B2 | 2/2016 | Bison |
| 9,802,722 | B1 | 10/2017 | Bison |
| 10,279,945 | B2 | 5/2019 | Nelson |
| 10,526,099 | B2 | 1/2020 | Bison |
| 10,960,998 | B2 | 3/2021 | Nicholson |
| 11,434,029 | B1 | 9/2022 | Bison |
| 11,628,959 | B1 | 4/2023 | Bison |
| 2004/0244336 | A1 | 12/2004 | Suolahti |
| 2005/0123721 | A1 | 6/2005 | Heikaus |
| 2008/0066431 | A1 | 3/2008 | Cousins |
| 2008/0092489 | A1 | 4/2008 | Smith |
| 2008/0209859 | A1 | 9/2008 | Vanderheiden |
| 2009/0178374 | A1 | 7/2009 | Lancaster, III |
| 2009/0277136 | A1 | 11/2009 | Van Amstel |
| 2009/0293425 | A1 | 12/2009 | Carter |
| 2011/0088359 | A1 | 4/2011 | Brocard |
| 2012/0102887 | A1 | 5/2012 | Lancaster, III |
| 2013/0104754 | A1 | 5/2013 | Van Amstel |
| 2013/0326999 | A1 | 12/2013 | Lemieux |
| 2014/0331609 | A1 | 11/2014 | Bison |
| 2015/0197355 | A1 | 7/2015 | Bison |
| 2015/0353220 | A1 | 12/2015 | Lancaster, III |
| 2016/0098171 | A1 | 4/2016 | Lancaster, III |
| 2017/0101205 | A1 | 4/2017 | Schieck |
| 2018/0208339 | A1 | 7/2018 | Bison |
| 2018/0257799 | A1 | 9/2018 | Ragsdale |
| 2019/0084703 | A1 | 3/2019 | Nicholson |
| 2020/0299016 | A1 | 9/2020 | Lancaster, III |
| 2020/0377250 | A1 | 12/2020 | Lancaster, III |

FOREIGN PATENT DOCUMENTS

| | | | |
|---|---|---|---|
| EP | 0178145 | A1 | 4/1986 |
| EP | 1332968 | A1 | 8/2003 |
| EP | 1803345 | A1 | 7/2007 |
| EP | 2589540 | A1 | 5/2013 |
| EP | 3070003 | A1 | 9/2016 |
| GB | 2241484 | A | 9/1991 |
| JP | H0245309 | | 2/1990 |
| JP | H04215903 | | 8/1992 |
| JP | H04327108 | | 11/1992 |
| JP | H10129609 | | 5/1998 |
| JP | 10129609 | A | 5/1999 |
| JP | 2000302102 | A | 10/2000 |
| JP | 2002166905 | A | 6/2002 |
| JP | 2002211502 | A | 7/2002 |
| JP | 2002225806 | A | 8/2002 |
| JP | 2002225807 | A | 8/2002 |
| WO | 9012737 | A1 | 11/1990 |
| WO | 2009155713 | A2 | 12/1990 |

OTHER PUBLICATIONS

JPO machine translation of JP 2002-225806 A, Aug. 14, 2013, 15 pages.

USPTO translation of JP 2-45309 A, Aug. 13, 2013, 7 pages.

PALLET WRAPPING SYSTEM WITH OVERLAPPING BANDS

CROSS REFERENCE TO RELATED APPLICATIONS

This application is a continuation of U.S. patent application Ser. No. 17/681,603 entitled "Pallet Wrapping System with Overlapping Bands" to Darrel Bison that was filed on Feb. 25, 2022, which application is a continuation-in-part of U.S. patent application Ser. No. 17/570,258 entitled "Pallet Wrapping System with Overlapping Bands" to Darrel Bison that was filed on Jan. 6, 2022, the disclosures of which are hereby incorporated herein by this reference. U.S. patent application Ser. No. 17/681,603 also claims the benefit of the filing date of U.S. Provisional Patent Application 63/153,880 entitled "Pallet Dual Roping and Wrapping Apparatus" to Darrel Bison that was filed on Feb. 25, 2021, the disclosure of which is hereby incorporated herein by this reference. U.S. patent application Ser. No. 17/681,603 is also a continuation-in-part of U.S. patent application Ser. No. 17/568,603 entitled "Shipping Pallet Wrapping System" to Darrel Bison that was filed on Jan. 4, 2022, which application is a continuation-in-part of U.S. patent application Ser. No. 17/222,843 entitled "Shipping Pallet Wrapping System" to Darrel Bison that was filed on Apr. 5, 2021, which application claims the benefit of the filing date of U.S. Provisional Patent Application No. 63/004,651 entitled "Shipping Pallet Wrapping System" to Darrel Bison that was filed on Apr. 3, 2020, the disclosures of which are hereby incorporated herein by this reference.

TECHNICAL FIELD

Aspects of this document relate generally to a pallet wrapping system, and more specifically to a pallet wrapping system with layered stretch film.

BACKGROUND

Goods to be transported in containers on, for example, ships, trucks, trains or the like frequently are packed on pallets. Such palletized goods or material may be wrapped in stretch film to protect the material from damage caused by, for example, shifting on a pallet or being bumped by goods on adjacent pallets.

A commonly acknowledged need in the industry is to develop systems and methods for reducing the amount of stretch film used per pallet, as well as the amount of time required to wrap each pallet, and/or to eliminate ancillary packaging materials such as corner boards and strapping, without sacrificing load containment.

SUMMARY

Aspects of this document relate to a pallet wrapping system comprising a support bar with a length extending vertically from a base, the support bar having a first channel and a second channel, wherein each of the first channel and the second channel extends parallel to the length of the support bar, a plurality of guides configured to narrow the width of stretch film as the stretch film passes through the plurality of guides and form a banded edge on the stretch film, wherein the plurality of guides comprises a first set of guides and a second set of guides, the first set of guides coupled to the first channel of the support bar, extending perpendicularly away from the support bar in a first direction, and configured to narrow the width of the stretch film to a first width, the second set of guides coupled to the second channel of the support bar, extending perpendicularly away from the support bar in a second direction opposite the first direction, and configured to narrow the width of the stretch film to a second width larger than the first width, a plurality of rollers extending parallel to the support bar, each roller of the plurality of rollers positioned adjacent to the plurality of guides and configured to facilitate passing the stretch film through the plurality of guides, a first roll of stretch film positioned to pass stretch film to the first set of guides, and a second roll of stretch film positioned to receive banded stretch film from the first set of guides, layer the banded stretch film onto unbanded stretch film to form an unbanded composite stretch film, and then pass the unbanded composite stretch film to the second set of guides to form a banded composite stretch film having a banded first ply with a width equal to the first width and a banded second ply with a width equal to the second width.

Particular embodiments may comprise one or more of the following features. The support bar may be positioned between the first roll of stretch film and the second roll of stretch film. A pre-stretch machine configured to receive and stretch the banded composite stretch film. The pallet wrapping system may be configured to form the unbanded composite stretch film by layering the banded stretch film onto the second roll of stretch film and then unwrap the unhanded composite stretch film from the second roll of stretch film to pass the unhanded composite stretch film to the second set of guides.

Aspects of this disclosure relate to a pallet wrapping system comprising a support bar with a length extending from a base, a plurality of guides configured to narrow the width of stretch film as the stretch film passes through the plurality of guides and form a banded edge on the stretch film, wherein the plurality of guides comprises a first set of guides and a second set of guides, the first set of guides coupled to and extending away from the support bar in a first direction and configured to narrow the width of the stretch film to a first width, the second set of guides coupled to and extending away from the support bar in a second direction opposite the first direction and configured to narrow the width of the stretch film to a second width larger than the first width, a plurality of rollers extending parallel to the support bar, each roller of the plurality of rollers configured to facilitate passing the stretch film through the plurality of guides, a first roll of stretch film positioned to pass stretch film to the first set of guides, and a second roll of stretch film positioned to receive banded stretch film from the first set of guides, layer the banded stretch film onto unbanded stretch film to form an unbanded composite stretch film, and then pass the unhanded composite stretch film to the second set of guides to form a banded composite stretch film having a banded first ply with a width equal to the first width and a banded second ply with a width equal to the second width.

Particular embodiments may include one or more of the following features. The support bar may have a first channel and a second channel each extending parallel to the length of the support bar, wherein the first set of guides is coupled to the first channel and the second set of guides is coupled to the second channel. Each roller of the plurality of rollers may be positioned adjacent to the plurality of guides. The pallet wrapping system may be configured to form the unbanded composite stretch film by layering the banded stretch film onto the second roll of stretch film and then unwrap the unbanded composite stretch film from the second roll of stretch film to pass the unbanded composite stretch film to the second set of guides. The support bar may be positioned between the first roll of stretch film and the second roll of stretch film. A pre-stretch machine configured to receive and stretch the banded composite stretch film. A path of the stretch film from the first roll of stretch film may extend around the support bar.

Aspects of the present disclosure relate to a pallet wrapping system comprising a support bar extending from a base, a plurality of guides coupled to the support bar and configured to form a banded edge on stretch film as the stretch film passes through the plurality of guides, wherein the plurality of guides comprises a first set of guides and a second set of guides, the first set of guides configured to narrow the width of the stretch film to a first width, the second set of guides configured to narrow the width of the stretch film to a second width larger than the first width, a first roll of stretch film positioned to pass stretch film to the first set of guides, and a second roll of stretch film positioned to receive banded stretch film from the first set of guides, layer the banded stretch film onto unbanded stretch film to form an unbanded composite stretch film, and then pass the unbanded composite stretch film to the second set of guides to form a banded composite stretch film having a banded first ply with a width equal to the first width and a banded second ply with a width equal to the second width.

Particular embodiments may include one or more of the following features. The support bar may have a first channel and a second channel each extending parallel to the support bar, wherein the first set of guides is coupled to the first channel and the second set of guides is coupled to the second channel. Each roller of the plurality of rollers may be positioned adjacent to the plurality of guides. The pallet wrapping system may be configured to form the unbanded composite stretch film by layering the banded stretch film onto the second roll of stretch film and then unwrap the unbanded composite stretch film from the second roll of stretch film to pass the unbanded composite stretch film to the second set of guides. The first set of guides may extend away from the support bar in a first direction and the second set of guides may extend away from the support bar in a second direction opposite the first direction. A plurality of rollers extending parallel to the support bar, each roller of the plurality of rollers configured to facilitate passing the stretch film through the plurality of guides. The support bar may be positioned between the first roll of stretch film and the second roll of stretch film. A pre-stretch machine configured to receive and stretch the banded composite stretch film. A path of the stretch film from the first roll of stretch film extends around the support bar.

Aspects of this document relate to a method of wrapping a palletized load comprising forming at least two composite stretch films including a first composite stretch film and a second composite stretch film, wherein forming each of the at least two composite stretch films comprises passing stretch film from a first spool through a first plurality of guides, narrowing a width of the stretch film from the first spool to create a first banded stretch film, wherein the first banded stretch film has a first width and a filament extending along each of a top edge and a bottom edge of the first banded stretch film, passing stretch film from a second spool through a second plurality of guides, narrowing a width of the stretch film from the second spool to create a second banded stretch film, wherein the second banded stretch film has a second width smaller than the first width and a filament extending along each of a top edge and a bottom edge of the second banded stretch film, and overlaying the second banded stretch film on the first banded stretch film to form each of the at least two composite stretch films, wherein each of the filaments of the second banded stretch film is positioned between the filaments of the first banded stretch film, after overlaying, pre-stretching each of the at least two composite stretch films by at least 275%, simultaneously wrapping each of the at least two composite stretch films around the palletized load, and leaving a gap having a width equal to or larger than the first width between the first composite stretch film and the second composite stretch film as the at least two composite stretch films are wrapped around the palletized load.

Particular embodiments may comprise one or more of the following features. Each of the at least two composite stretch films may be pre-stretched by between 275% and 340%. The first width may be between 1.5 inches and 15 inches. Forming each of the at least two composite stretch films further may comprise centering the second banded stretch film on the first banded stretch film.

Aspects of this document relate to a method of wrapping a palletized load comprising forming at least two composite stretch films including a first composite stretch film and a second composite stretch film, wherein forming each of the at least two composite stretch films comprises narrowing a width of stretch film from a first spool to create a first banded stretch film with a first width and a filament extending along each of a top edge and a bottom edge of the first banded stretch film, narrowing a width of stretch film from a second spool to create a second banded stretch film with a second width and a filament extending along each of a top edge and a bottom edge of the second banded stretch film, wherein the second width is smaller than the first width, overlaying the second banded stretch film on the first banded stretch film to form each of the at least two composite stretch films, wherein each of the filaments of the second banded stretch film is positioned between the filaments of the first banded stretch film, wrapping each of the at least two composite stretch films around the palletized load, and leaving a gap having a width equal to or larger than the first width between the first composite stretch film and the second composite stretch film as the at least two composite stretch films are wrapped around the palletized load.

Particular embodiments may comprise one or more of the following features. The method may further comprise pre-stretching the composite stretch film by at least 275%. The method may further comprise pre-stretching the composite stretch film by between 300% and 340%. the first width may be between 1.5 inches and 15 inches. Forming each of the at least two composite stretch films may further comprise centering the second banded stretch film on the first banded stretch film. Wrapping each of the at least two composite stretch films around the palletized load may occur simultaneously. The at least two composite stretch films may further include a third composite stretch film and the method may further comprise leaving a gap having a width equal to or larger than the first width between the second composite stretch film and the third composite stretch film as the at least two composite stretch films are wrapped around the palletized load.

Aspects of this document relate to a method of wrapping a palletized load comprising forming at least two composite stretch films including a first composite stretch film and a second composite stretch film, wherein forming each of the at least two composite stretch films comprises narrowing a width of stretch film from a first spool to create a first banded stretch film with a first width, narrowing a width of stretch film from a second spool to create a second banded stretch film with a second width, wherein the second width is smaller than the first width, and overlaying the second banded stretch film on the first banded stretch film to form each of the at least two composite stretch films, wherein the second banded stretch film is positioned between a top edge and a bottom edge of the first banded stretch film, wrapping each of the at least two composite stretch films around the palletized load, and leaving a gap having a width that is equal to or larger than half of the first width between the first composite stretch film and the second composite stretch film as the at least two composite stretch films are wrapped around the palletized load Particular embodiments may comprise one or more of the following features. The first banded stretch film may have a filament extending along each of the top edge and the bottom edge and the second banded stretch film may have a filament extending along each of a top edge and a bottom edge of the second banded stretch film. Forming the at least two composite stretch films may further comprise passing the stretch film from the first spool through a first plurality of guides and passing the stretch film from the second spool through a second plurality of guides. The method may further comprise pre-stretching the composite stretch film by at least 275%. The method may further comprise pre-stretching the composite stretch film by between 300% and 340%. The first width may be between 1.5 inches and 15 inches. Forming each of the at least two composite stretch films may further comprise centering the second banded stretch film on the first banded stretch film. Wrapping each of the at least two composite stretch films around the palletized load may occur simultaneously. The at least two composite stretch films may further include a third composite stretch film and the method may further comprise leaving a gap having a width equal to or larger than half of the first width between the second composite stretch film and the third composite stretch film as the at least two composite stretch films are wrapped around the palletized load.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
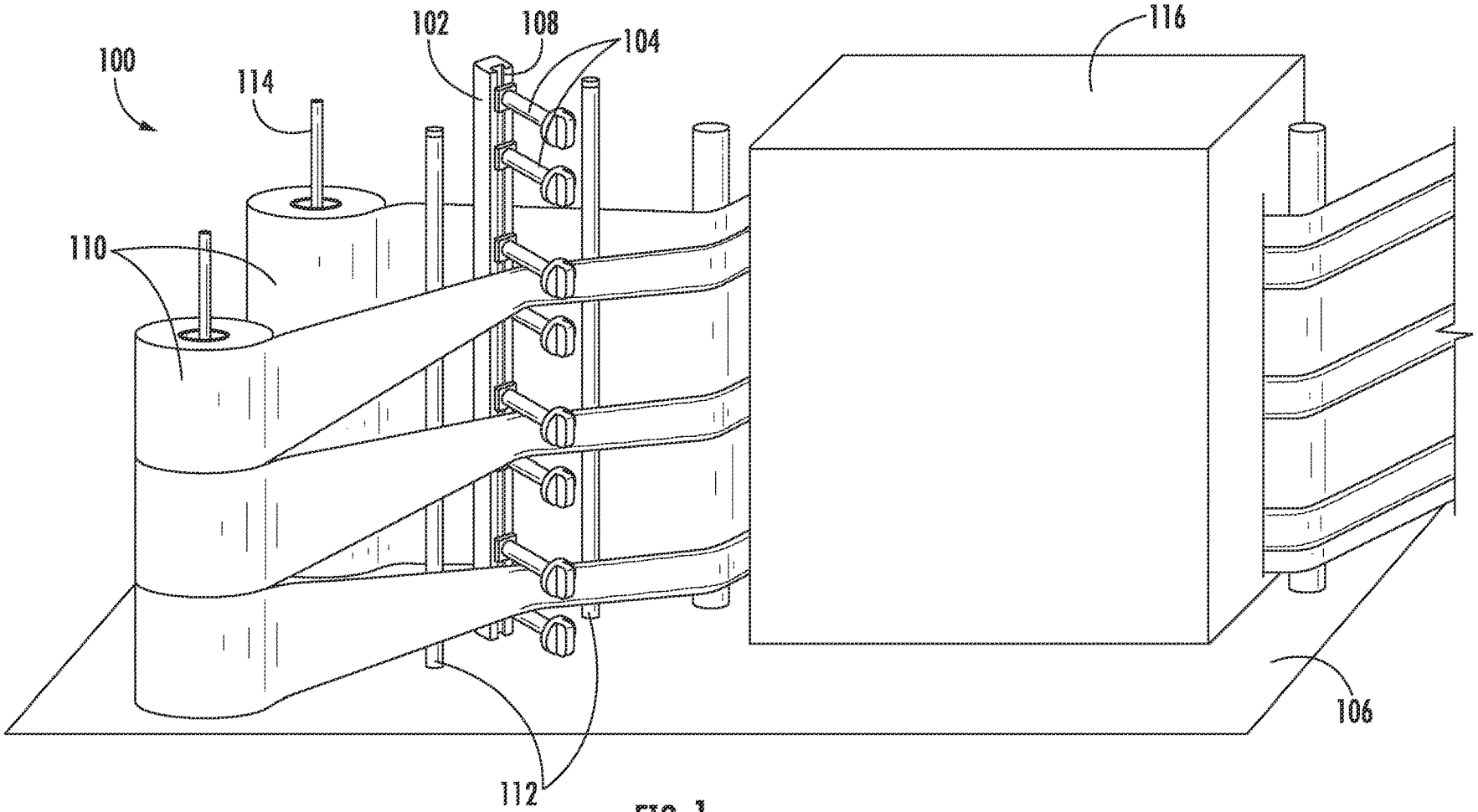
FIG. 1 is a perspective view of a shipping pallet wrapping system.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

Figure 2:
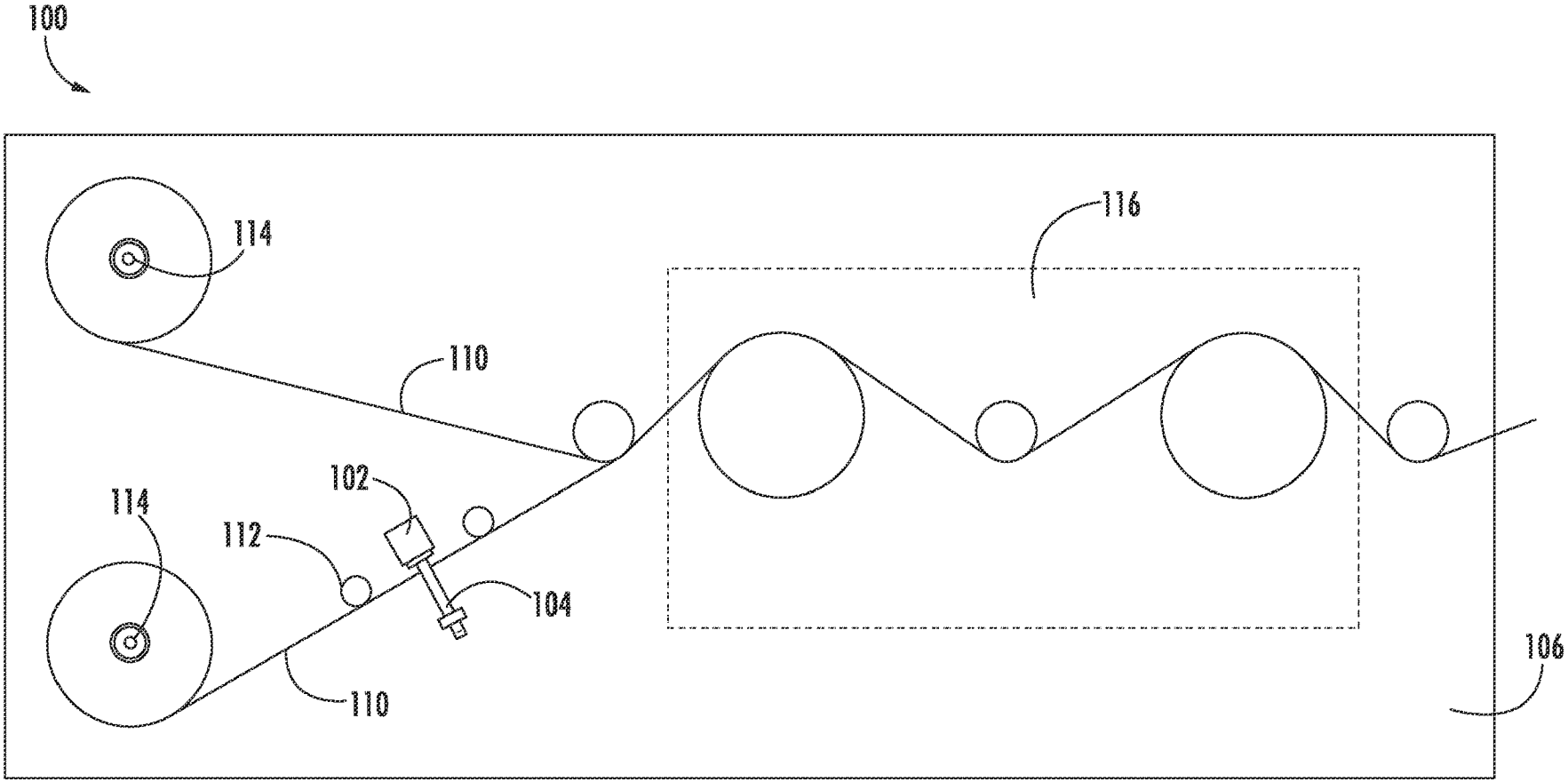
FIG. 2 is a top view of the shipping pallet wrapping system shown in FIG. 1.

The present disclosure relates to a shipping pallet wrapping system 100 that is configured to wrap a palletized load. The shipping pallet wrapping system 100 has a support bar 102 and at least one adjustment arm 104, as shown in FIGS. 1-2. The support bar 102 extends up from a base 106, and may have a channel 108 that extends parallel to a length of the support bar 102 for a majority of the length of the support bar 102 (see FIG. 3). The adjustment arms 104 are coupled to the support bar 102 and are configured to narrow the width of a stretch film 110 for wrapping a palletized load. The shipping pallet wrapping system 100 additionally may have a roller 112, at least one spool 114, and a pre-stretch carriage 116. In some embodiments, the roller 112 is separated from the support bar 102 and extends up from the base 106 parallel to the support bar 102. In some embodiments, the roller 112 is attached to the support bar 102 and extends up from the base 106 parallel to the support bar 102. The roller 112 is configured to guide the stretch film to pass between the adjustment arms 104. The at least one spool 114 extends up from the base 106 and supports at least one roll of the stretch film 110. The at least one spool 114 may be located on a first side of the support bar 102, and the at least one roll of stretch film 110 is configured to supply the stretch film 110 to the adjustment arms 104. A blade may be positioned between the roll of stretch film 110 and the adjustment arms 104 and may be configured to cut the stretch film 110 as the stretch film 110 moves from the spool 114 to the adjustment arms 104. The pre-stretch carriage 116 may be on a second side of the support bar 102 opposite the first side, is supported by the base 106, and is configured to receive the stretch film 110 from the adjustment arms 104 and stretch the stretch film 110 in preparation for wrapping the palletized load.

Figure 3:
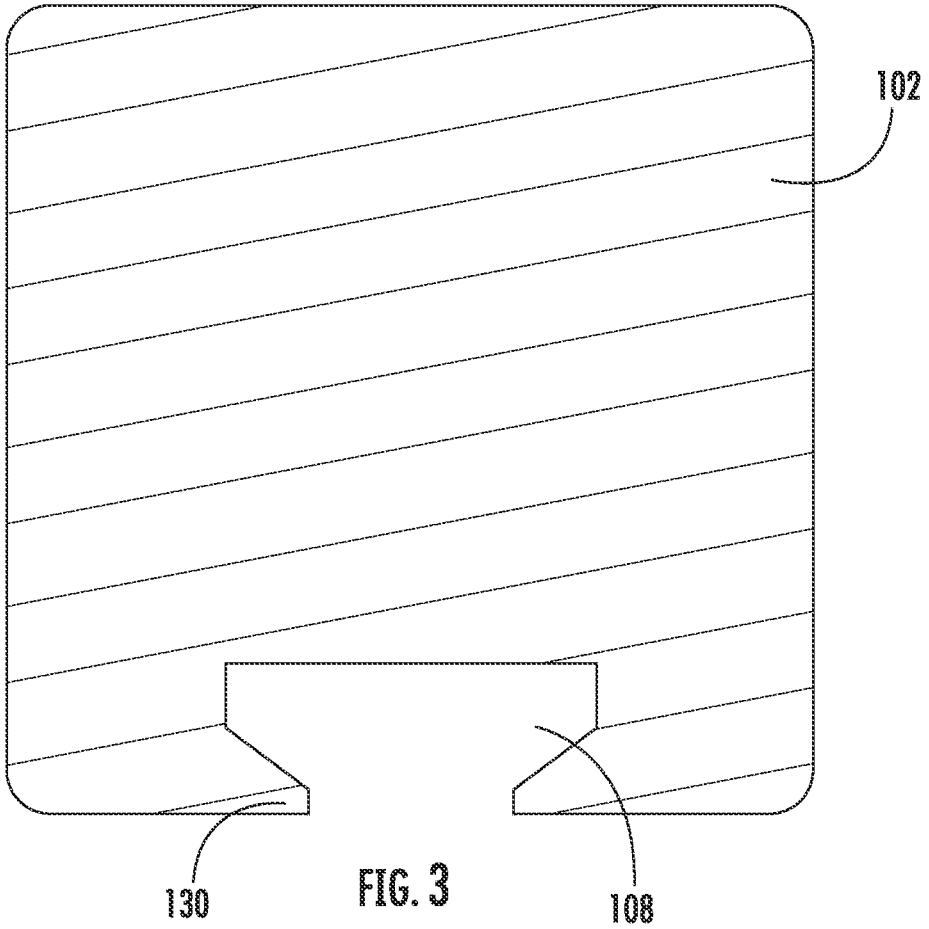
FIG. 3 is a cross section view of the support bar of the shipping pallet wrapping system shown in FIG. 1.
Figure 4:
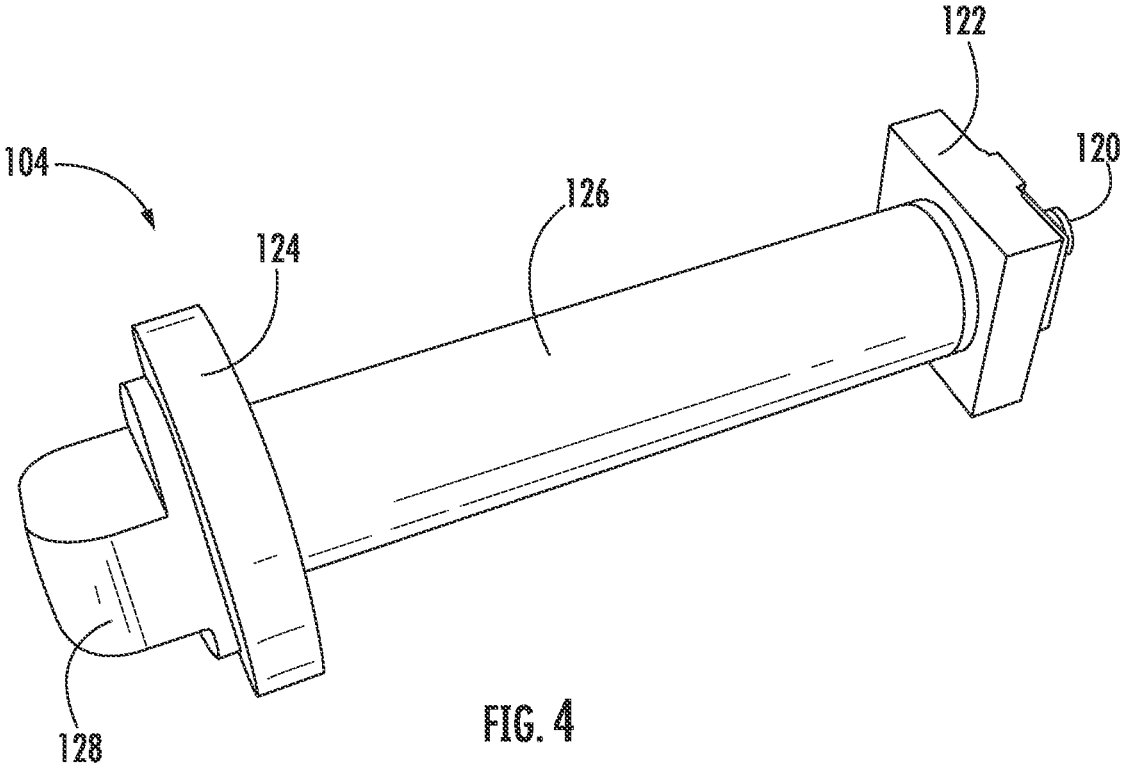
FIG. 4 is a perspective view of an adjustment arm of the shipping pallet wrapping system shown in FIG. 1.
Figure 5:
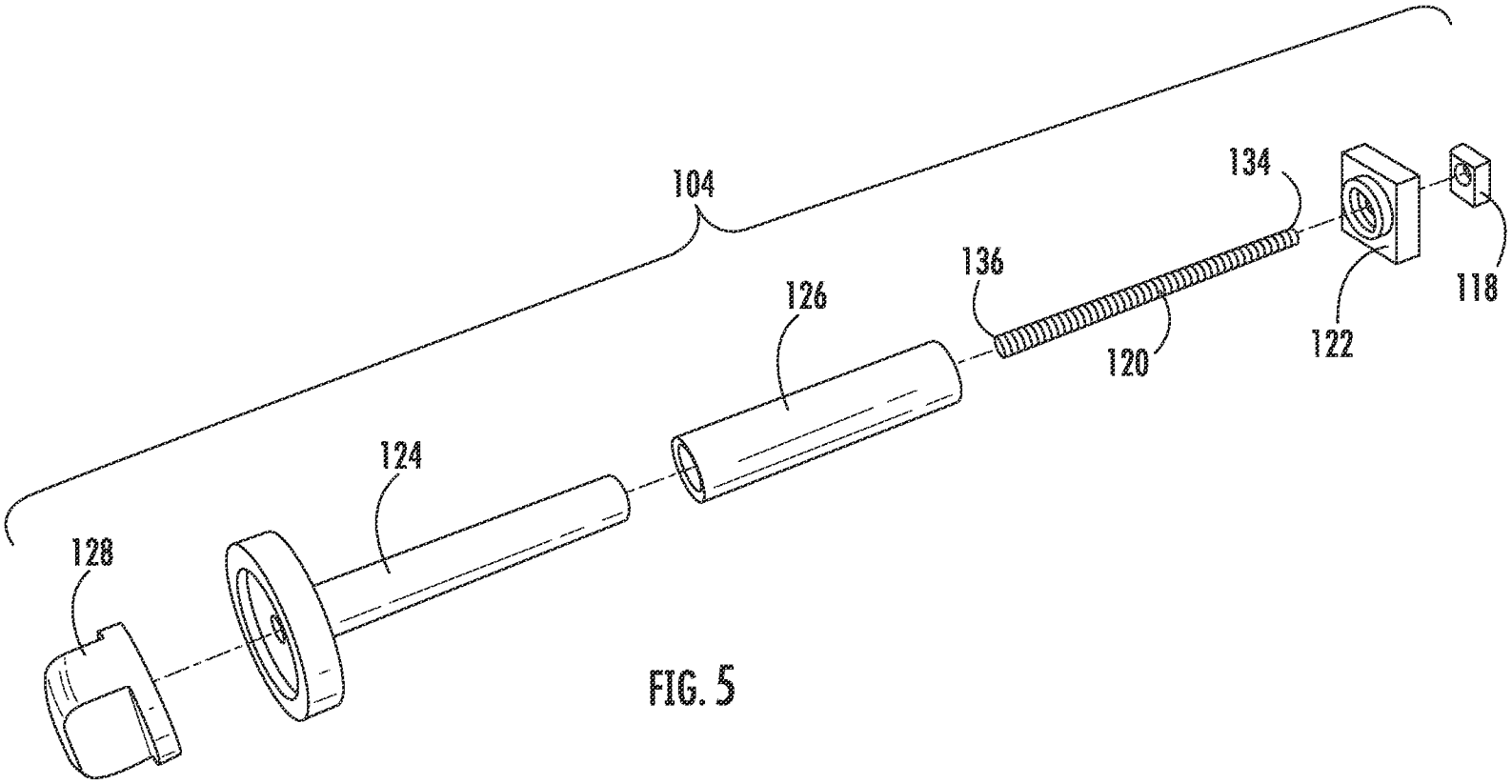
FIG. 5 is an exploded view of the adjustment arm shown in FIG. 4.
Figure 6:
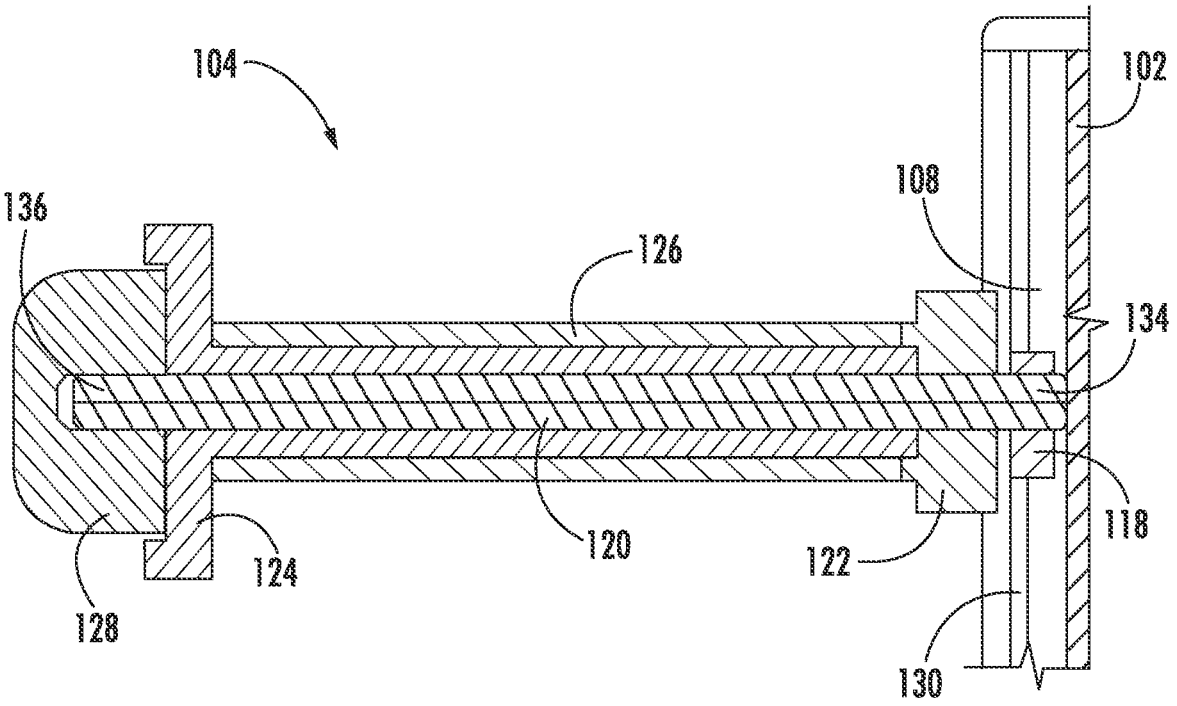
FIG. 6 is a cross section view of the adjustment arm shown in FIG. 4.
Figure 7:
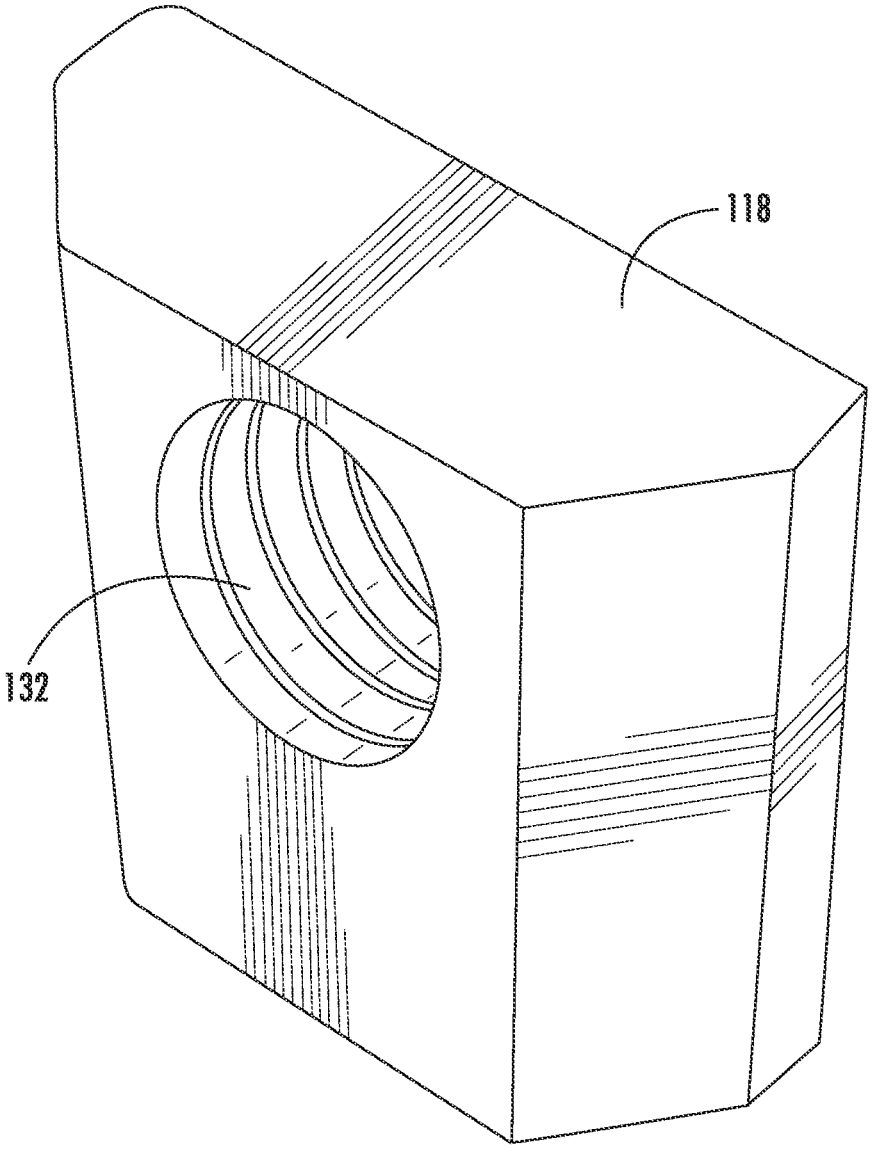
FIG. 7 is a first perspective view of the captive nut of the adjustment arm shown in FIG. 4.
Figure 8:
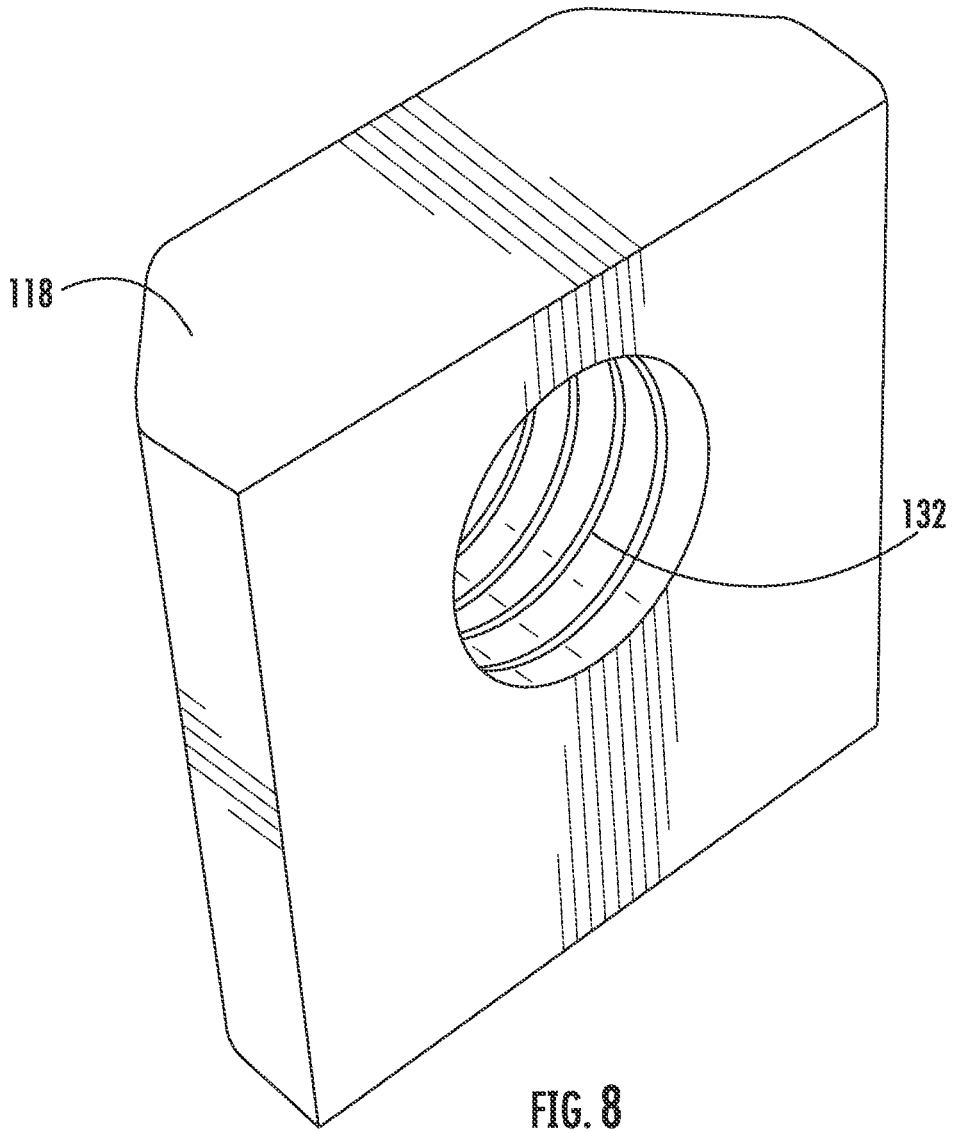
FIG. 8 is a second perspective view of the captive nut shown in FIG. 7.

Each of the adjustment arms 104 may comprise a captive nut 118, a stud 120, a guide base 122, a guide 124, a sleeve 126 and an adjustment knob 128, as shown in FIGS. 4-6. The captive nut 118 is coupled to and configured to translate along the support bar 102. In some embodiments, the captive nut 118 may be positioned within the channel 108 and the channel 108 may have a lip 130 configured to retain the captive nut 118 within the channel 108 (see FIG. 3). The captive nut 118 may be coupled to the support bar 102 in some other way. For example, the captive nut 118 may be configured to extend around the support bar 102 as a sleeve. In some embodiments, the captive nut 118 has a first hole 132 coupled with the stud 120. As shown in FIGS. 7-8, the first hole 132 may be threaded, and is configured to receive the stud 120. When the stud 120 is inserted further into the first hole 132, either by moving along the threads of the first hole 132 or by some other mechanism, the captive nut 118 tightens into place against the support bar 102, thus temporarily fixing the adjustment arm 104 into place. The embodiment of the captive nut 118 shown in FIGS. 7-8 is rectangular in shape and has a cross section that matches the shape of the channel 108 (see FIG. 3). Other embodiments of the captive nut 118 may be any other shape, and may even be a sleeve, as disclosed above.

The stud 120 has a fixed end 134 coupled to the captive nut 118 and a free end 136 extending away from the support bar 102. The stud 120 may be externally threaded along the entirety of its length, may be threaded on the fixed end 134 and the free end 136, but not in the middle, or may not be threaded at all. The stud 120 provides support and connection from the support bar 102 along the length of the adjustment arm 104.

Figure 9:
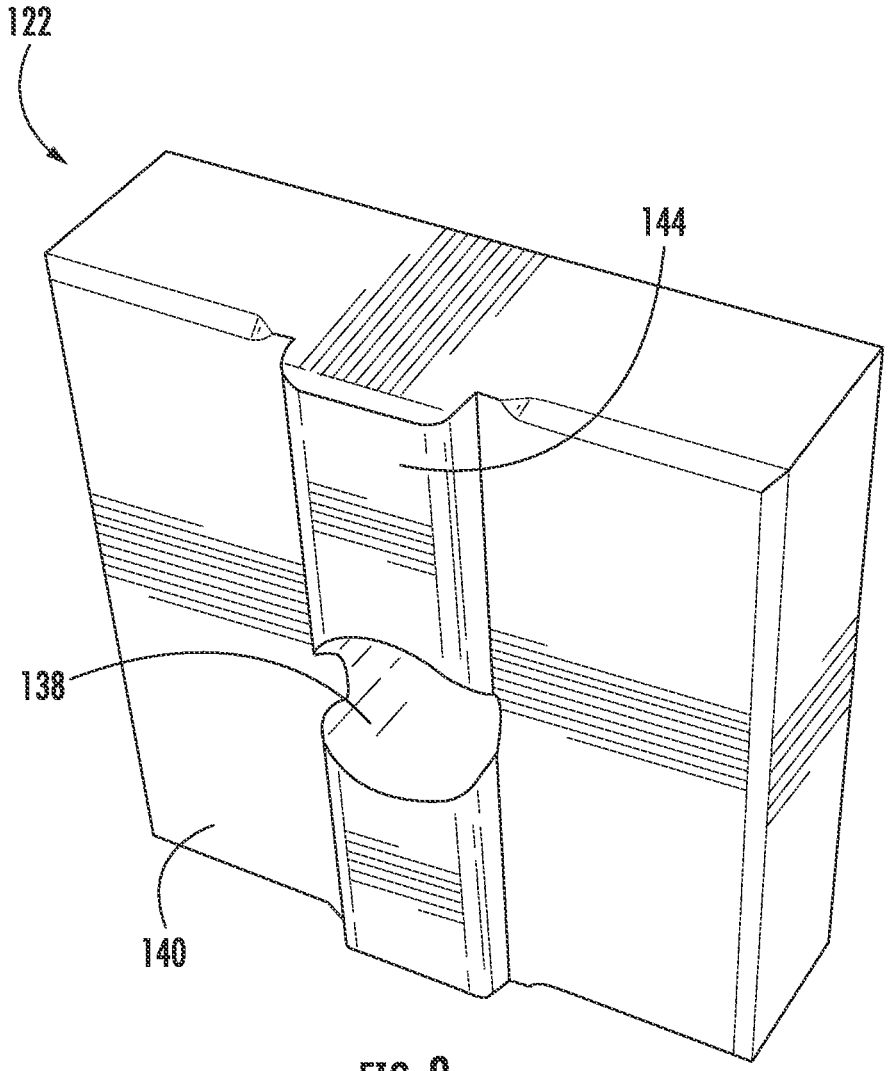
FIG. 9 is a first perspective view of the guide base of the adjustment arm shown in FIG. 4.
Figure 10:
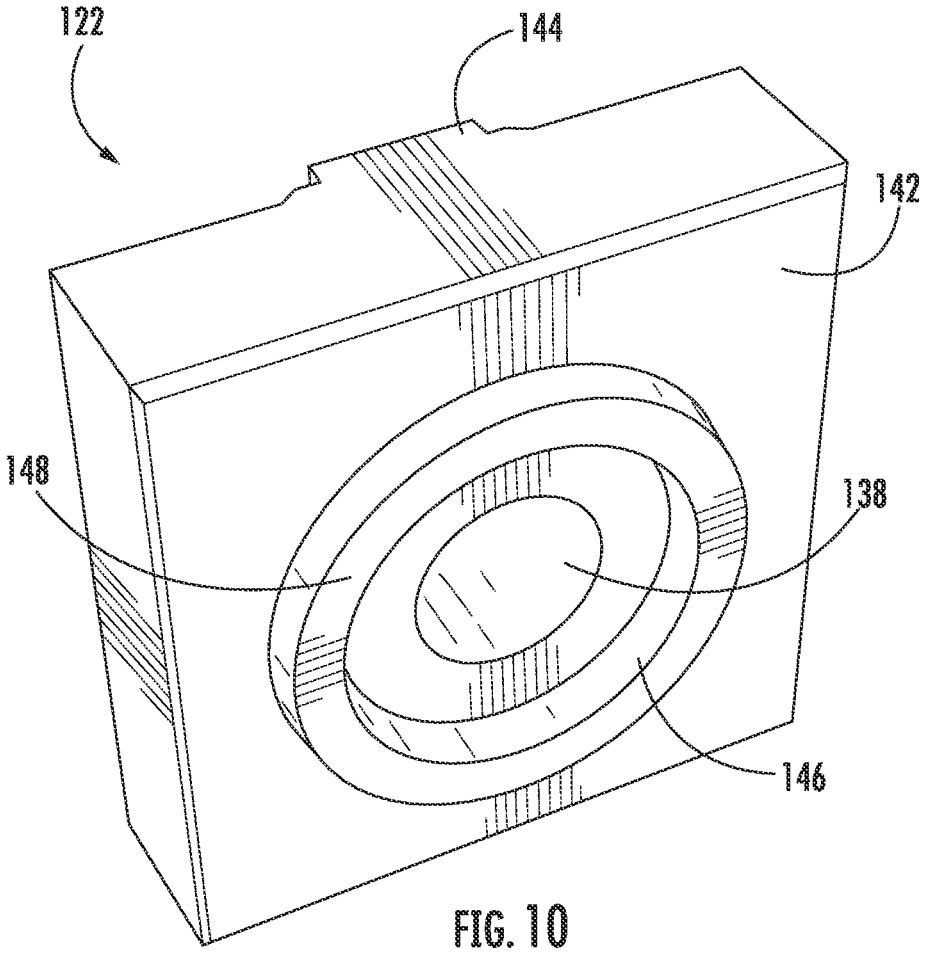
FIG. 10 is a second perspective view of the guide base shown in FIG. 9.

Turning to FIGS. 9-10, the guide base 122 has a stud aperture 138 extending through a first side 140 and a second side 142 of the guide base 122. The stud 120 extends through the stud aperture 138, thus supporting the guide base 122. To provide additional support to the guide base 122 and help keep the adjustment arm 104 aligned, the guide base 122 may have a raised central ridge 144 on the first side 140 of the guide base 122, as shown in FIG. 9. The raised central ridge 144 may protrude into the channel 108 of the support bar 102 (see FIG. 6). Alternatively, the captive nut 118 may have a slot into which the raised central ridge 144 protrudes. The guide base 122 may also have a retention barrier 146 on the second side 142 of the guide base 122, as shown in FIG. 10. The retention barrier 146 is configured to help keep the guide 124 aligned with the stud 120. By maintaining alignment of the various components of the adjustment arm 104, any forces applied to the adjustment arm 104 are more effectively transferred to the support bar 102, thus reducing the potential for damage to the adjustment arm 104 to occur. The retention barrier may comprise a raised lip 148 surrounding the stud aperture 138.

Figure 11:
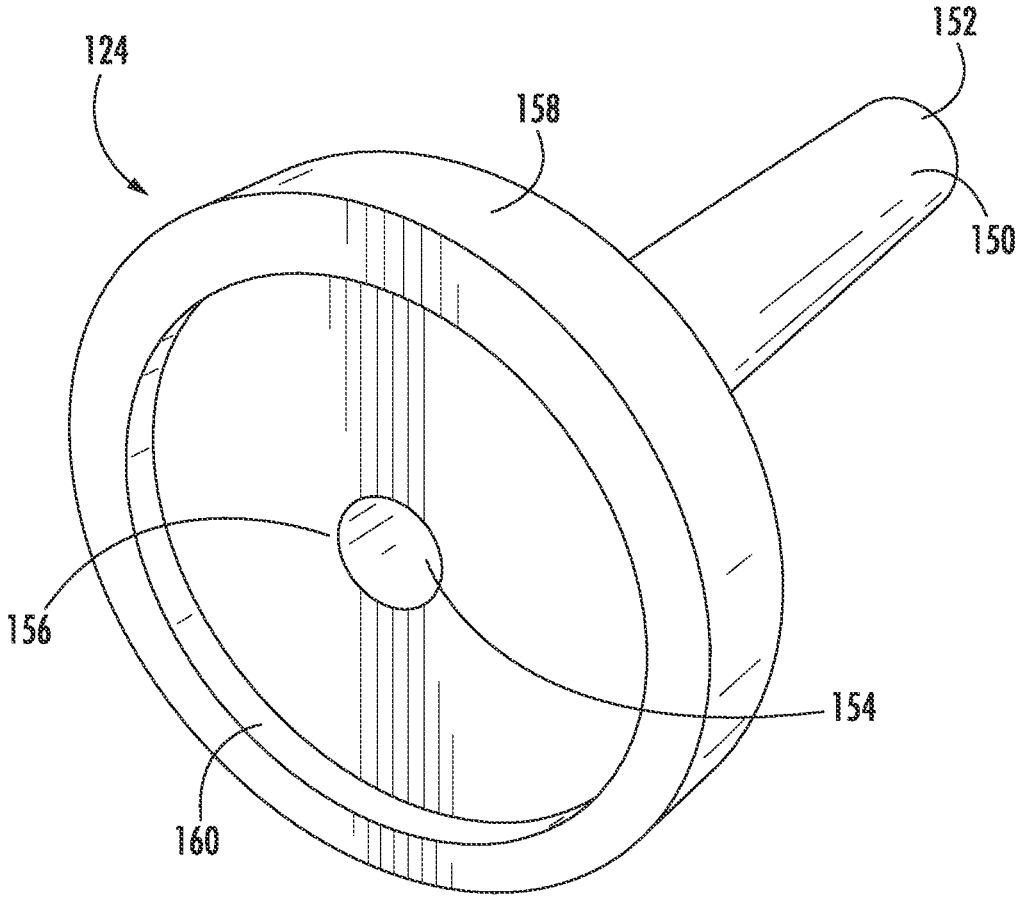
FIG. 11 is a first perspective view of the guide of the adjustment arm shown in FIG. 4.
Figure 12:
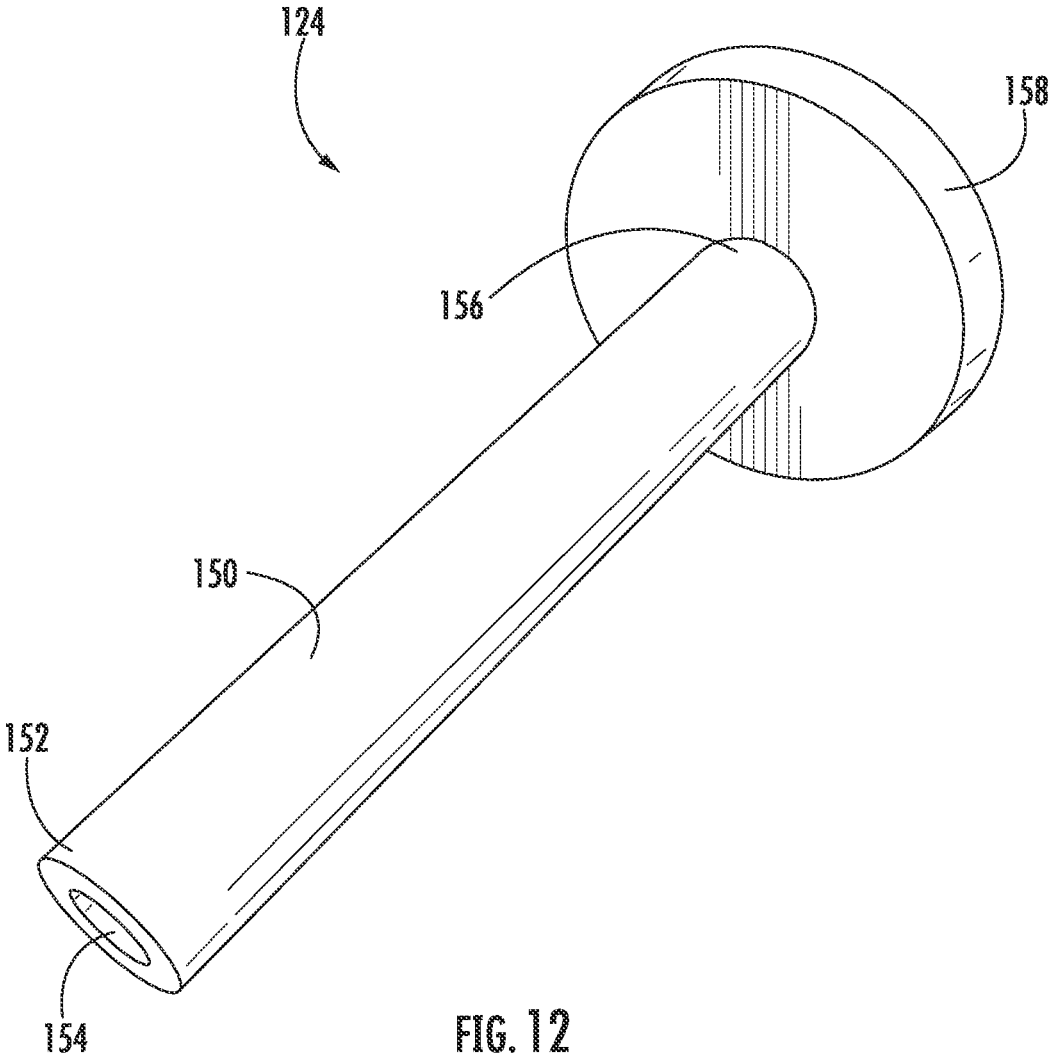
FIG. 12 is a second perspective view of the guide shown in FIG. 11.

Turning to FIG. 11-12, the guide 124 has a cylindrical body 150. The cylindrical body 150 may have a first end 152 nested within the retention barrier 146, helping align the guide 124 with the stud 120 as disclosed above. A central aperture 154 extends through a center of the cylindrical body 150. The central aperture 154 is aligned with the stud aperture 138, and the stud 120 extends through the central aperture 154. The cylindrical body 150 also has a second end 156 distal to the first end 152. A support flange 158 may extend radially outward from the second end 156 of the cylindrical body 150 and may have a recess 160. The support flange 158 and the recess 160 are configured to provide support to the adjustment knob 128 by aligning the adjustment knob 128 with the stud 120, similar to the way that the retention barrier 146 and the raised lip 148 provide support to the cylindrical body 150. As discussed above, this alignment helps to transfer forces applied to the adjustment arm 104 to the support bar 102 and decreases the damage done to the adjustment arm 104. In addition, the support flange 158 helps to retain the stretch film 110 between the adjustment arms 104. The sleeve 126 may surround the cylindrical body 150 and may be configured to rotate freely about the cylindrical body 150. Because the stretch film 110 directly contacts the sleeve 126, this rotation decreases the occurrence of kinetic friction between the stretch film 110 and the sleeve 126, which in turn decreases the likelihood that the stretch film 110 tears during wrapping activity. In addition, the larger diameter of the sleeve 126 improves a smoother roll-over of the edge of the stretch film 110 when narrowing the width of the stretch film 110. As the stretch film 110 passes over the sleeve 126, the edge of the stretch film 110 tends to have a more consistent, wider roll-over edge as compared to stretch film 110 passed over an adjustment arm 104 with a smaller diameter. This more consistent banded edge provides additional strength to the stretch film wrapped around the palletized load.

Figure 13:
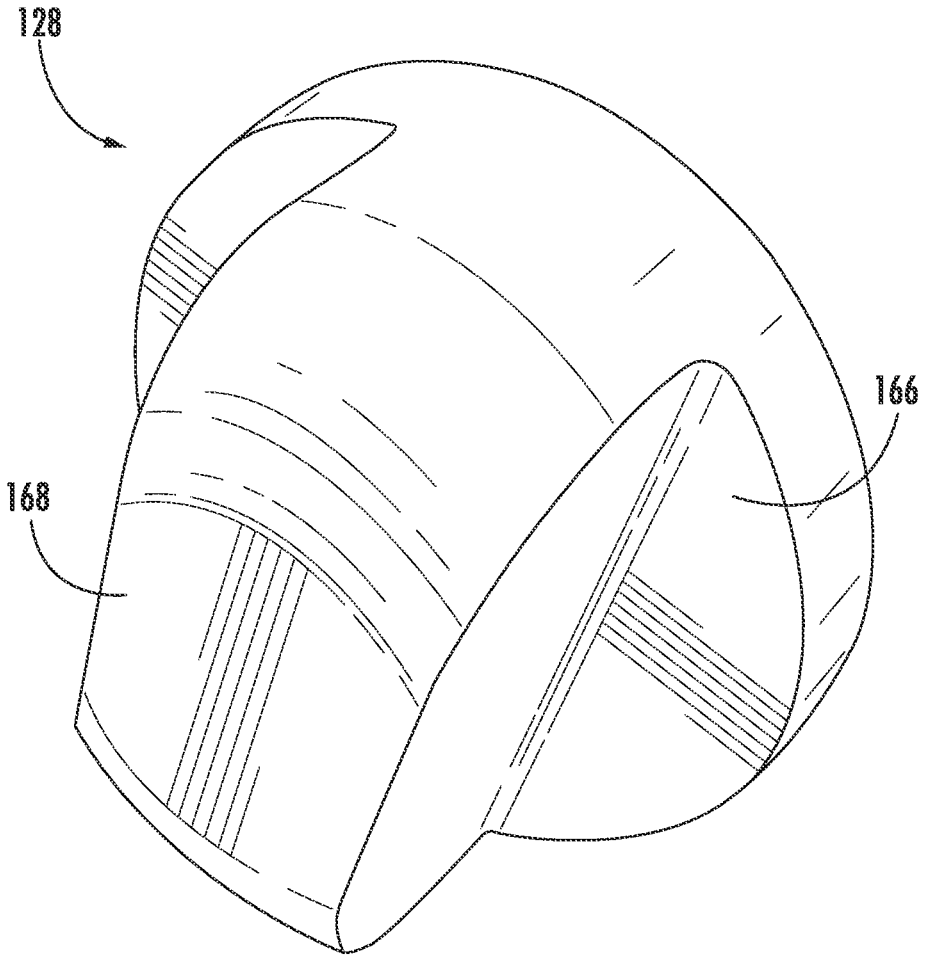
FIG. 13 is a first perspective view of the adjustment knob of the adjustment arm shown in FIG. 4.
Figure 14:
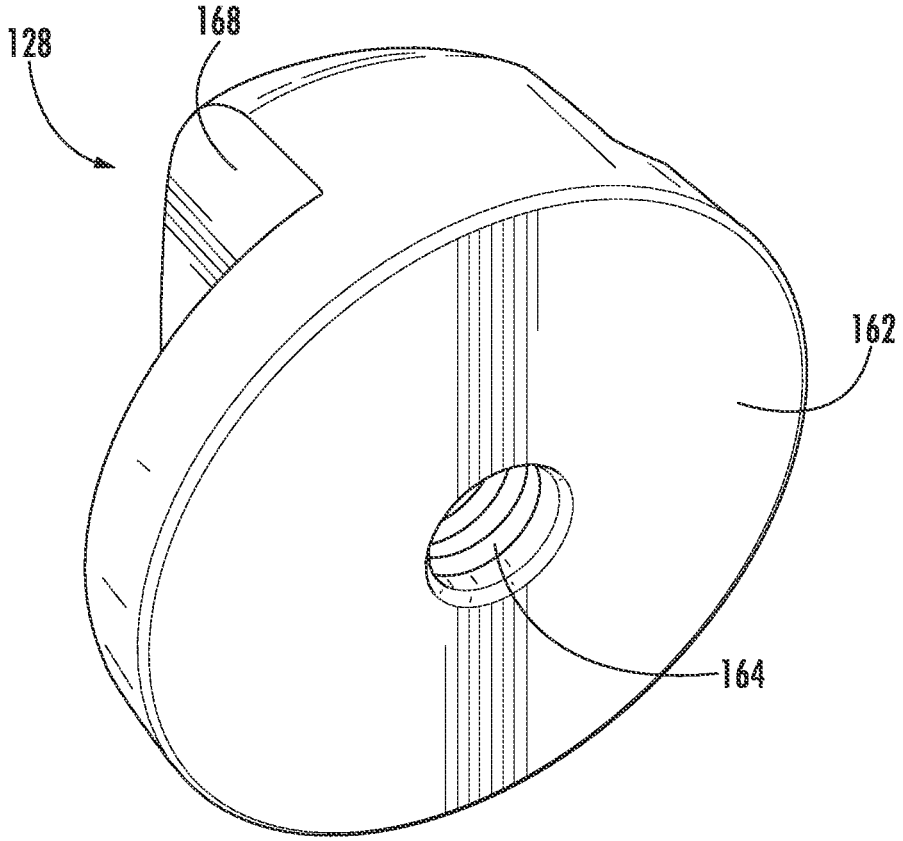
FIG. 14 is a second perspective view of the adjustment knob shown in FIG. 13.

The adjustment knob 128 may be nested within the recess 160 of the support flange 158, providing support to the adjustment knob 128 as discussed above. As shown in FIGS. 13-14, the adjustment knob 128 has a first side 162, which may have a second hole 164. The second hole 164 may be threaded and is aligned with the central aperture 154 and the stud aperture 138. The free end 136 of the stud 120 is coupled to the second hole 164 of the adjustment knob 128 (see FIG. 6). The adjustment knob 128 may also have a second side 166 with a grip 168. The grip 168 is configured to facilitate rotation of the adjustment knob 128 by a user. A benefit of the adjustment knob 128 is that the adjustment knob 128 can be tightened onto the stud 120 without the use of any tools. The grip 168 provides sufficient surfaces for twisting the adjustment knob 128 by hand. These surfaces are also sufficient for use with a tool as well, if the user desires to use a tool.

Each of the adjustment arms 104 is configured to tighten onto the support bar 102 when the corresponding adjustment knob 128 is rotated in a first direction, and to loosen off of the support bar 102 when the corresponding adjustment knob 128 is rotated in a second direction opposite the first direction. Because the adjustment knob 128 is on the free end 136 of the stud 120, which is distal to the support bar 102, the adjustment knob 128 is easily accessible. A location of each of the adjustment arms 104 is adjustable along the support bar 102. Thus, the adjustment knob 128 can be used to loosen the adjustment arm 104, and the adjustment arm 104 can then be moved along the support bar 102 to a new desired location. Once in the new location, the adjustment knob 128 can then be tightened onto the stud 120, and thus onto the support bar 102. Adjusting the position of the adjustment arms 104 can thus be done relatively quickly, saving time and money.

Figure 15:
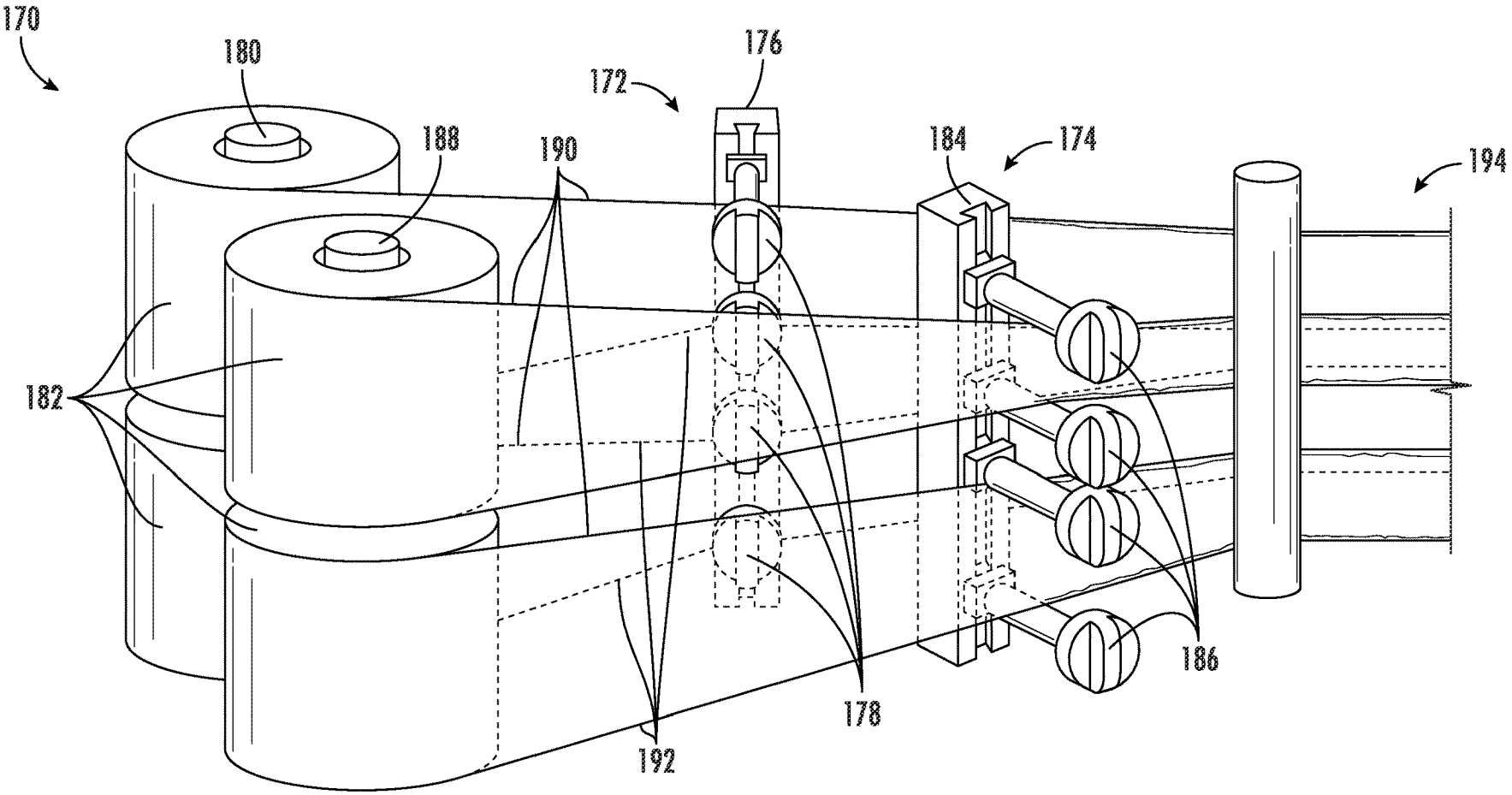
FIG. 15 is a perspective view of another shipping pallet wrapping system.
Figure 16:
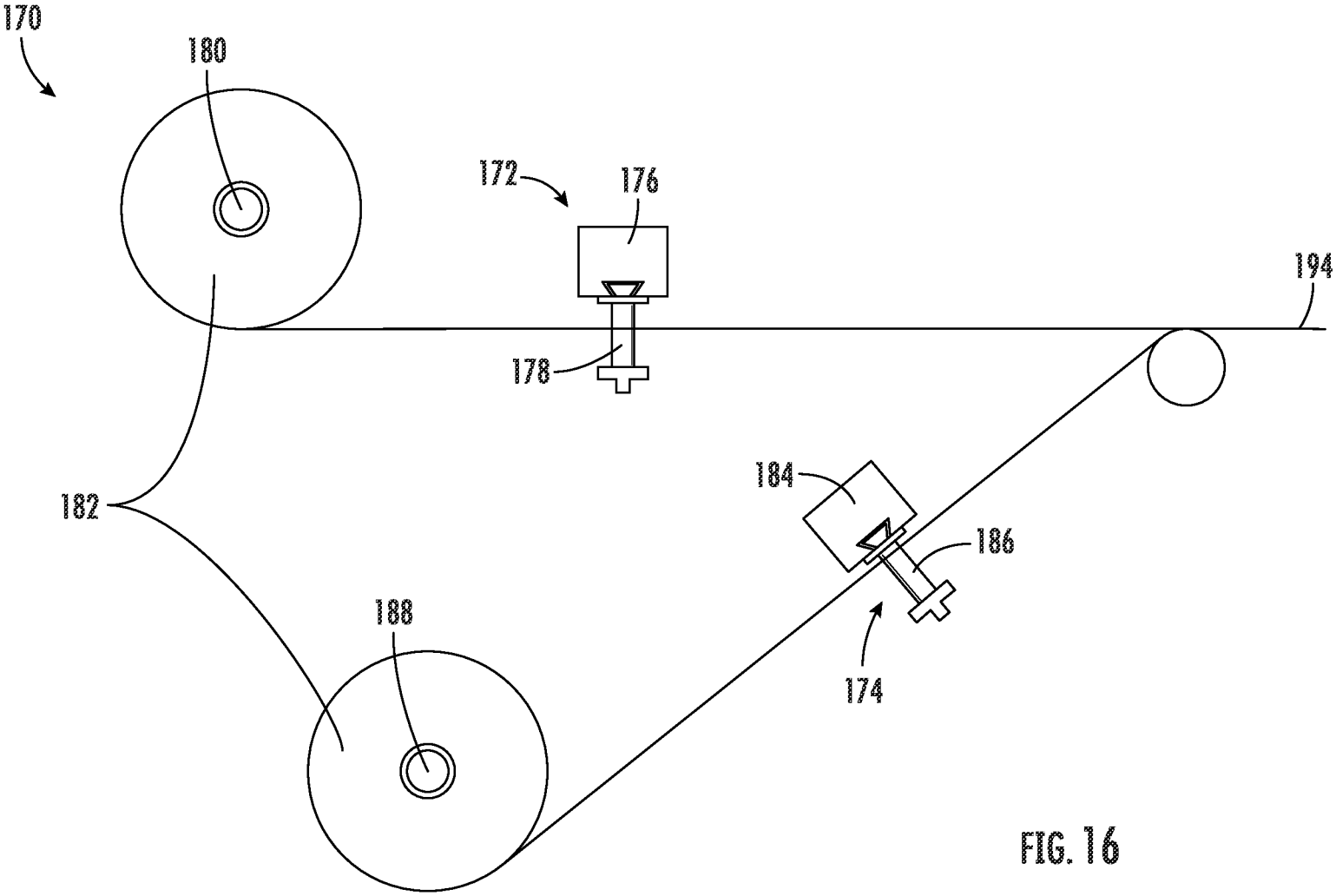
FIG. 16 is a top view of the shipping pallet wrapping system shown in FIG. 15.

As illustrated in FIGS. 15-16, a particular embodiment of the shipping pallet wrapping system 100 may be configured as an apparatus 170 comprising a first wrapping system 172 and a second wrapping system 174. The first wrapping system 172 may have a first support bar 176, a first set of adjustment arms 178 coupled to the first support bar 176, and a first spool 180 of stretch film configured to feed stretch film through the first set of adjustment arms 178. The first set of adjustment arms 178 may be slidably coupled to the first support bar 176 and may include a plurality of pairs of adjustment arms 104. The first spool 180 may include more than one roll of stretch film 182. For example, the first spool 180 may have at least two rolls of stretch film 182, such as a first roll of stretch film and a third roll of stretch film. The rolls of stretch film 182 on the first spool 180 may be configured to dispense from the first spool 180 at the same rate. Similarly, the second wrapping system 174 may have a second support bar 184, a second set of adjustment arms 186 coupled to the second support bar 184, and a second spool 188 of stretch film configured to feed stretch film through the second set of adjustment arms 186. In some embodiments, the second support bar 184 and the first support bar 176 may be integrated into one support bar, with both the first set of adjustment arms 178 and the second set of adjustment arms 186 both coupled to the same support bar. The second set of adjustment arms 186 may be slidably coupled to the second support bar 184 and may include a plurality of pairs of adjustment arms 104. The second spool 188 may include more than one roll of stretch film 182. For example, the second spool 188 may have at least two rolls of stretch film 182, such as a second roll of stretch film and a fourth roll of stretch film. Like the rolls of stretch film 182 on the first spool 180, the rolls of stretch film 182 on the second spool 188 may be configured to dispense from the second pool 188 at the same rate. The stretch film from each of the rolls of stretch film 182 has a top edge 190 and a bottom edge 192. Multiple rollers 112 may be used to facilitate directing the bands into the adjustment arms 104.

The components of the apparatus 170 may be substantially similar to the corresponding components described above and may have any of the features or characteristics disclosed. For example, the first support 176 and the second support bar 184 may be substantially similar to the support bar 102, and thus may extend up from the base 106 and may have a channel 108 that extends parallel to the length of the support bar. As another example, the first set of adjustment arms 178 and the second set of adjustment arms 186 may each include a plurality of adjustment arms 104 as described above. As another example, the first spool 180 and the second spool 188 may be substantially similar to the spool 114 as described above.

Figure 17:
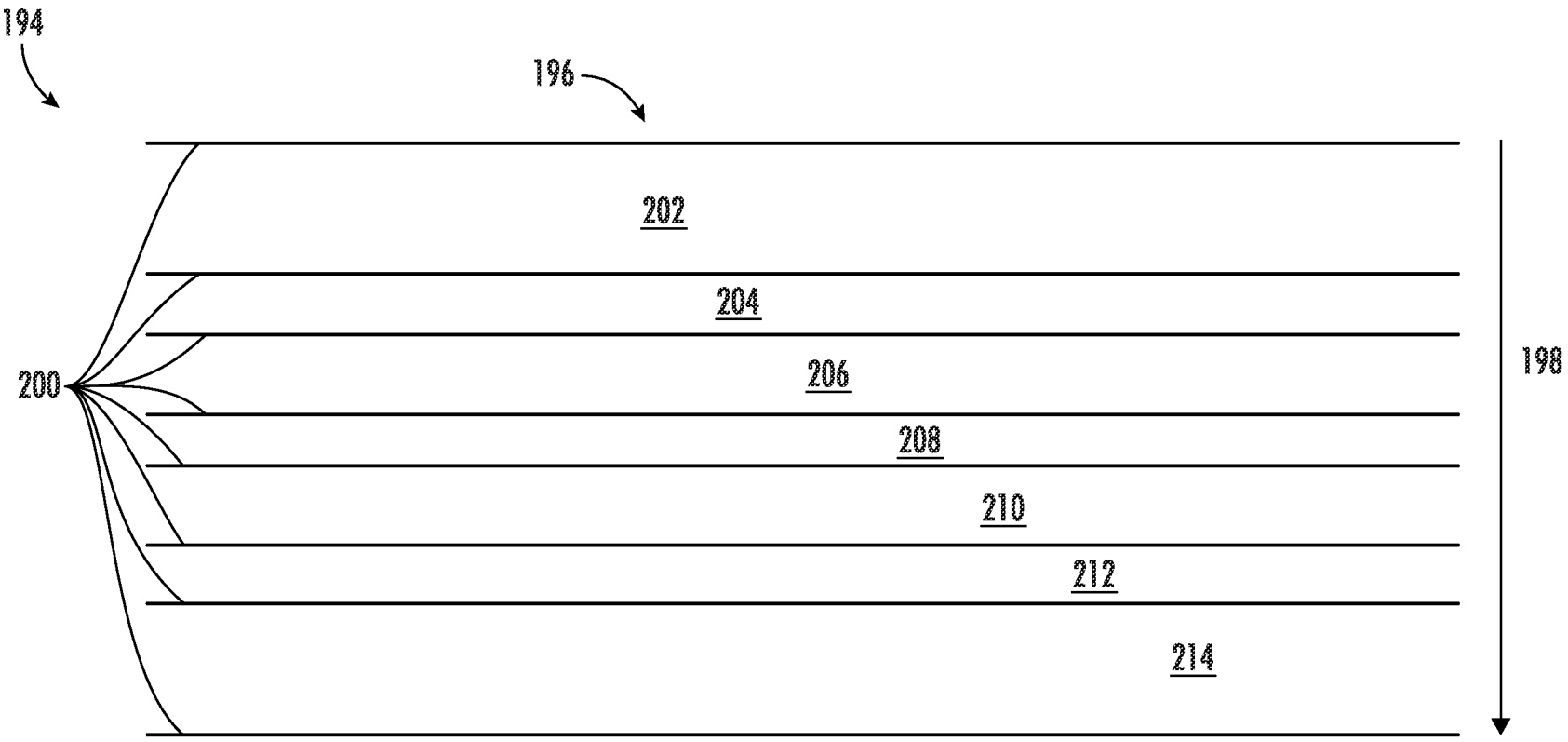
FIG. 17 is a perspective view of a composite stretch film created by the shipping pallet wrapping system shown in FIG. 15.

The apparatus 170 can be used to create a composite stretch film 194. As shown in FIG. 17, the composite stretch film 194 comprises a plurality of sections 196. The plurality of sections 196 may be oriented parallel to the stretch film. In other words, moving in a transverse direction 198 across the composite stretch film 194, each section of the plurality of sections 196 may be stacked one on top of the other. The plurality of sections 196 may alternate between sections with one layer of stretch film and sections with two layers of stretch film. In addition, each section of the plurality of sections 196 may be separated from adjacent sections of the plurality of sections 196 by a banded border 200. The banded borders 200 are created when the stretch film is passed through the sets of adjustment arms as the adjustment arms narrow the width of the stretch film prior to creating the composite stretch film 194. The plurality of sections 196 may include a first section 202, a second section 204 adjacent to the first section 202, a third section 206 adjacent to the second section 204, a fourth section 208 adjacent to the third section 206, a fifth section 210 adjacent to the fourth section 208, a sixth section 212 adjacent to the fifth section 210, and a seventh section 214 adjacent to the sixth section 212. The first section 202, the third section 206, the fifth section 210, and the seventh section 214 may have one layer of stretch film and the second section 204, the fourth section 208, and the sixth section 212 may have two layers of stretch film.

Figure 18:
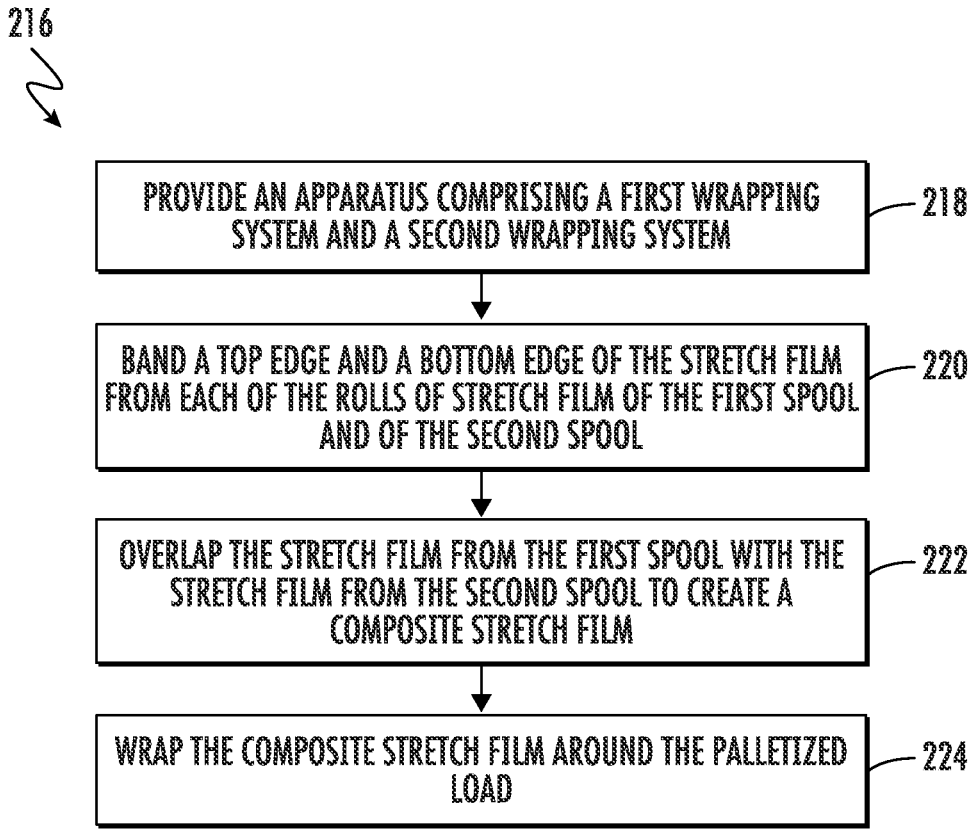
FIG. 18 is a process diagram illustrating the method of wrapping a palletized load using the shipping pallet wrapping system shown in FIG. 15.

As illustrated in FIG. 18, a method of wrapping a palletized load 216 with the apparatus 170 may comprise providing the apparatus 218, banding a top edge and a bottom edge of the stretch film from each of the rolls of stretch film of the first spool and of the second spool 220, overlapping the stretch film from the first spool with the stretch film from the second spool to create a composite stretch film 222, and wrapping the composite stretch film around the palletized load 224. Banding the top edge 190 and the bottom edge 192 of the stretch film from each of the rolls of stretch film 182 of the first spool 180 and of the second spool 188 occurs by passing the stretch film from the first spool 180 through the first set of adjustment arms 178 and passing the stretch film from the second spool 188 through the second set of adjustment arms 186. Because each pair of adjustment arms 104 of the first set of adjustment arms 178 and of the second set of adjustment arms 186 are separated by a distance less than a width of the stretch film, when the stretch film passes through the first set of adjustment arms 178 or the second set of adjustment arms 186, the top edge 190 and the bottom edge 192 are each banded, narrowing the width of the stretch film. As discussed above, the banded borders 200 provide additional strength to the stretch film. Once the stretch film has been banded, the stretch film from the first spool 180 is overlapped with the stretch film from the second spool 188 to create the composite stretch film 194. Thus, the sections of the composite stretch film 194 that have two layers of stretch film are a result of the overlapping stretch film. The composite stretch film 194 may be created before wrapping the composite stretch film 194 around the palletized load. This allows the stretch film to be more precisely overlapped, thus contributing to the strength of the composite stretch film 194. In addition, this allows the stretch film from the first spool 180 to be pressed against the stretch film from the second spool 188 before wrapping the palletized load, which also increases the strength of the composite stretch film 194.

The present disclosure is also related to a pallet wrapping system 300 that creates a composite stretch film that is designed to reduce the amount of stretch film required to secure a palletized load for shipping and decrease the amount of time required to wrap the palletized load. Many of the features described above in relation to the pallet wrapping system 100 are the same for the pallet wrapping system 300. Thus, components which have similar names or which have similar structures may have similar features, even when not explicitly stated or described herein. For example, the support bar 102 disclosed above and the support bar 302 disclosed below may each have any features disclosed herein in relation to the other of the two. Similarly, the adjustment arms 104 disclosed above may have any of the features disclosed below regarding the plurality of guides 304 and vice versa. Any combinations of the features of the pallet wrapping system 100 and the pallet wrapping system 300 are possible and contemplated by this disclosure.

Figure 19:
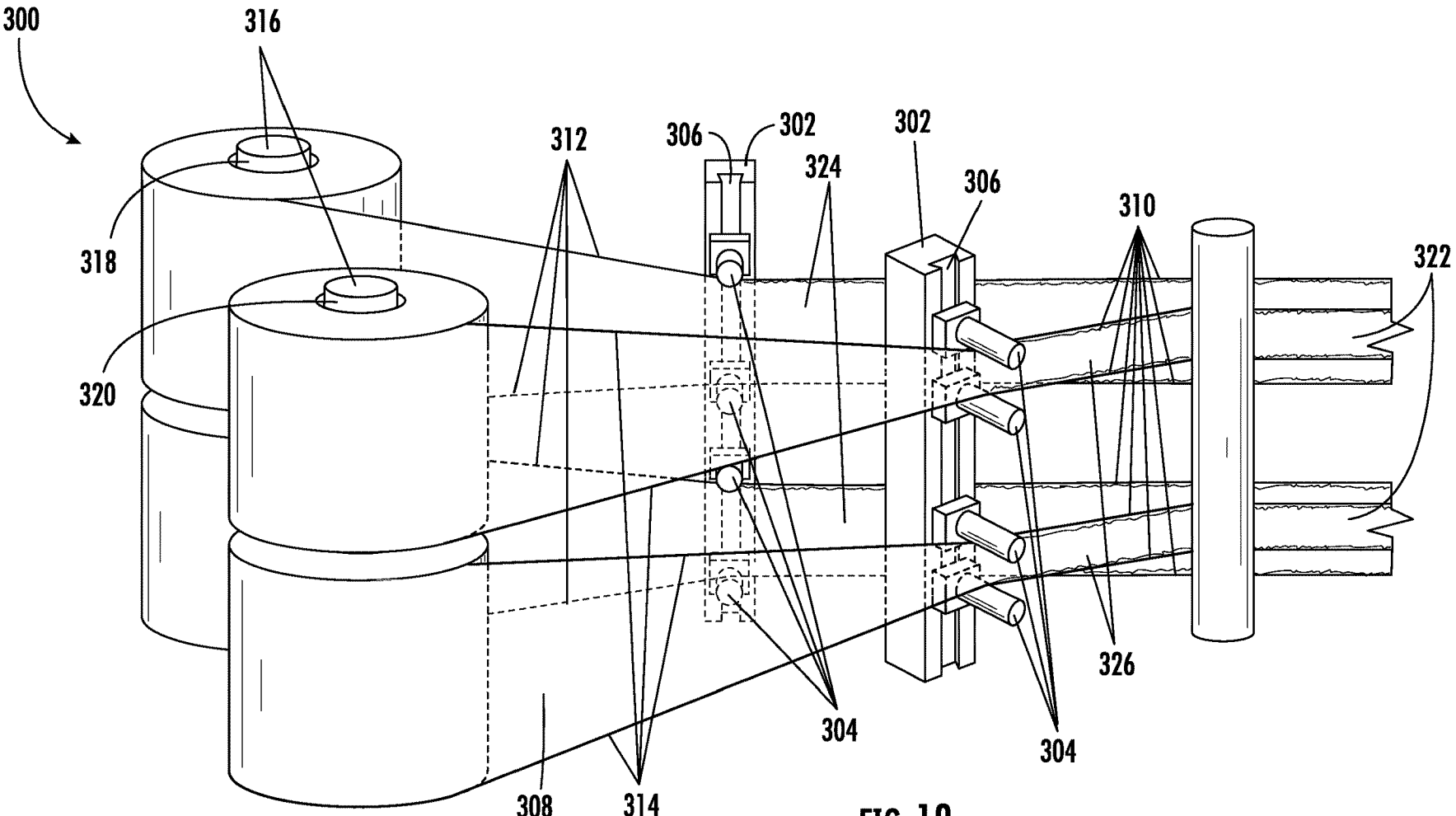
FIG. 19 is a perspective view of another pallet wrapping system.
Figure 20:
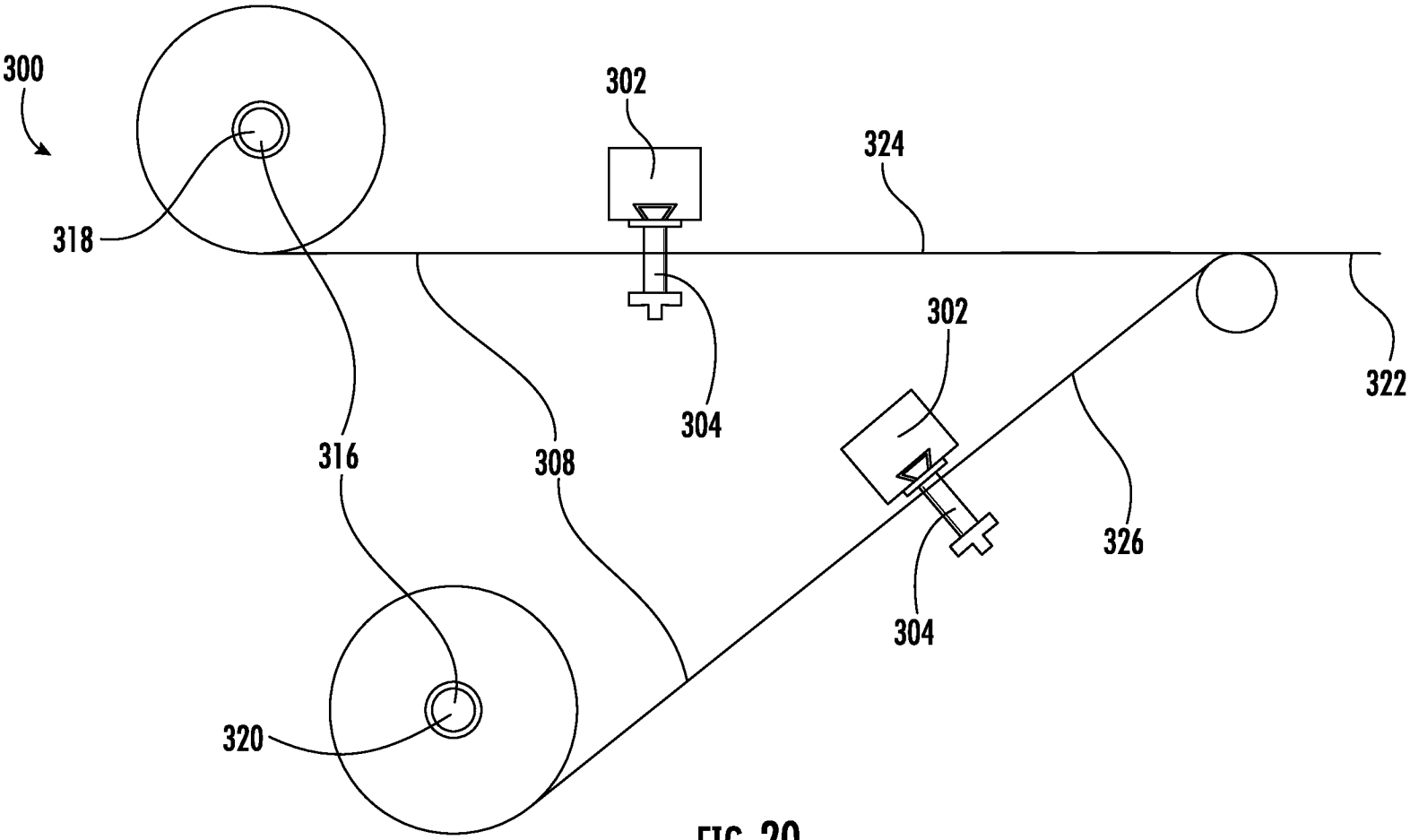
FIG. 20 is a top view of the pallet wrapping system shown in FIG. 19.

The pallet wrapping system 300 may comprise a plurality of support bars 302 and a plurality of guides 304, as shown in FIGS. 19-20. The support bar 302 may have a channel 306 that extends parallel to a length of the support bar 302 for a majority of the length of the support bar 302. This allows the plurality of guides 304 to be affixed to the support bar 302 at any desired position along the channel 306. Each of the guides 304 may have any of the features of the adjustment arms 104 disclosed above. The plurality of guides 304 are coupled to the support bar 302 and are configured to narrow the width of a stretch film 308 for wrapping a palletized load. As shown in FIGS. 19-20, the plurality of guides 304 may be arranged in pairs, with each pair separated by a distance less than the width of the stretch film 308. Thus, when the stretch film 308 passes through the plurality of guides 304, the guides 304 form a filament 310 on the top edge 312 and the bottom edge 314 of the stretch film 308 to result in a narrower stretch film with banded edges. The filament 310 is an edge of the stretch film 308 that has been banded, rolled, folded, bunched together, etc. The filament 310 provides additional strength to the stretch film 308 because of its resistance towards tearing. Because the plurality of guides 304 can be affixed to the support bar 302 at any desired position along the channel 306, the user can adjust the plurality of guides 304 to adjust the width of the banded stretch film exiting the plurality of guides 304.

The pallet wrapping system 300 may also comprise at least one spool 316 configured to hold and dispense the stretch film 308. The at least one spool 316 may comprise a first spool 318 and a second spool 320, as shown in FIGS. 19-20. Each of the at least one spool 316 may have more than one roll of stretch film 308. The rolls of stretch film 308 on the same spool 316 may be configured to dispense from the spool 316 at the same rate.

Figure 21:
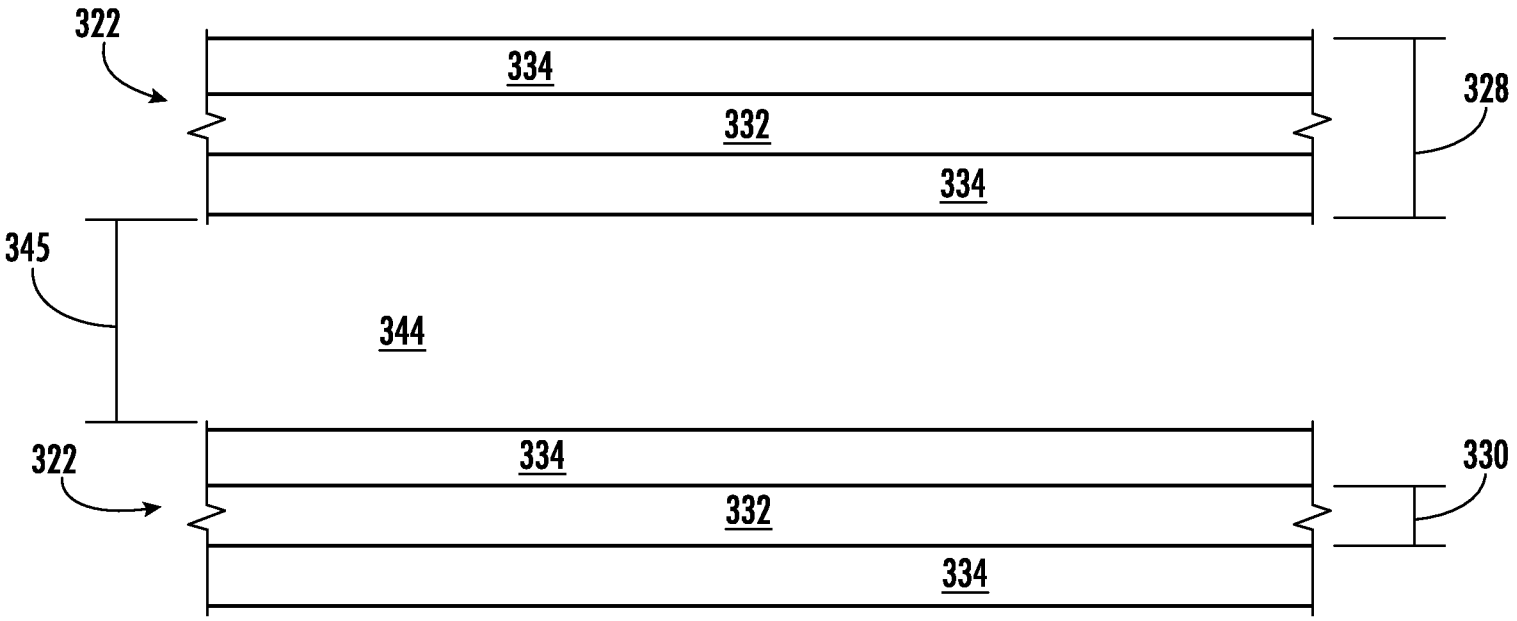
FIG. 21 is a front view of a composite stretch film created by the pallet wrapping system shown in FIG. 19.

The pallet wrapping system 300 may be used to form a composite stretch film 322, as shown in FIG. 19 and FIG. 21, which may be wrapped around a palletized load. The composite stretch film 322 may be formed from two rolls of stretch film 308. For example, stretch film 308 from the first spool 318 may be passed through a first plurality of guides 304, thus narrowing a width of the stretch film 308 from the first spool 318 to create a first banded stretch film 324, and stretch film 308 from the second spool 320 may be passed through a second plurality of guides 304, thus narrowing a width of the stretch film 308 from the second spool 320 to create a second banded stretch film 326. The first banded stretch film 324 has a first width 328 and the second banded stretch film 326 has a second width 330. For example, the first width may be between 1.5 inches and 15 inches. In some embodiments, the first width is between 3.5 inches and 5 inches. The second width 330 may be smaller than the first width 328. The second banded stretch film 326 may be overlayed on the first banded stretch film 324 with each of the filaments 310 of the second banded stretch film 326 positioned between the filaments 310 of the first banded stretch film 324. In other words, once overlayed onto the first banded stretch film 324, the second banded stretch film 326 may be positioned between the top edge 312 and the bottom edge 314 of the first banded stretch film 324, as shown in FIG. 21. Thus, each composite stretch film 322 may have a central region 332 with two layers of stretch film 308 and two side regions 334 with one layer of stretch film 308, with each region separated from adjacent regions by a filament 310.

Figure 22:
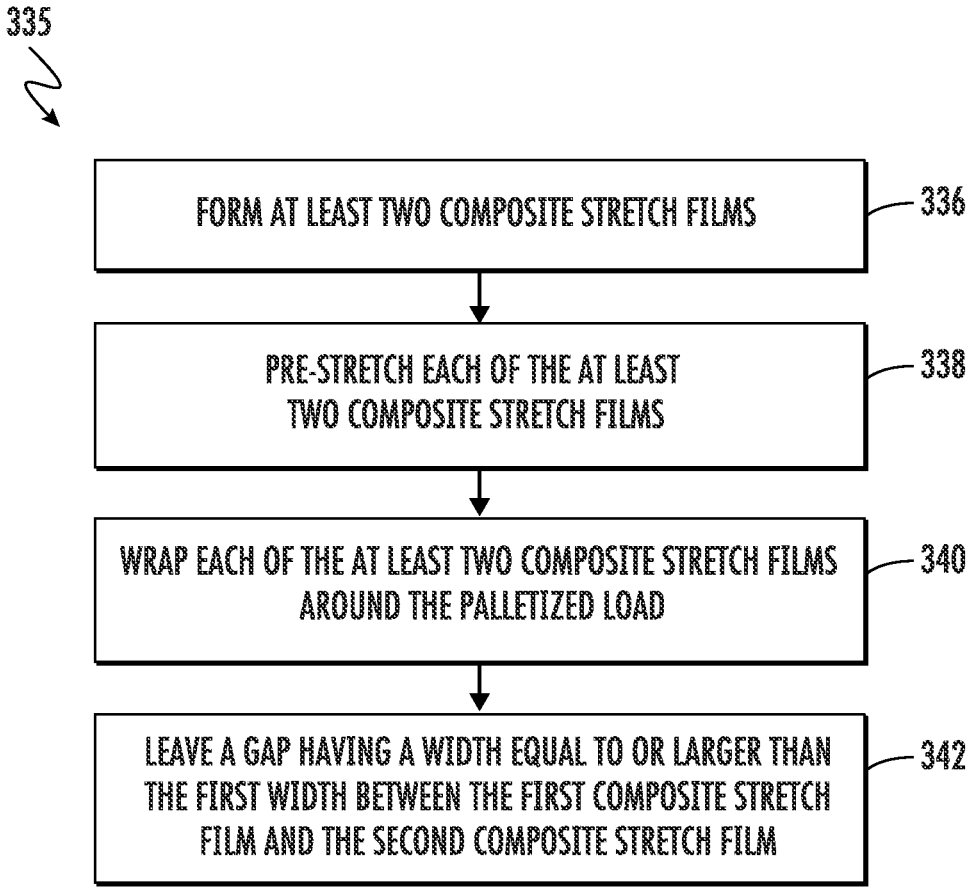
FIG. 22 is a process diagram illustrating the method of wrapping a palletized load using the pallet wrapping system shown in FIG. 19.

As shown in FIG. 22, wrapping a palletized load 335 may comprise forming at least two composite stretch films 336, which may include a first composite stretch film 322, a second composite stretch film 322, and a third composite stretch film 322, pre-stretching each of the at least two composite stretch films 338, wrapping each of the at least two composite stretch films around the palletized load 340, and, as the at least two composite stretch films are wrapped around the palletized load, leaving a gap between the first composite stretch film and the second composite stretch film 342. The gap 344 may have a width 345 equal to or larger than the first width of the first banded stretch film. A similar gap may be left between the second composite stretch film 322 and the third composite stretch film 322 as the at least two composite stretch films are wrapped around the palletized load.

During conventional wrapping of palletized loads, the stretch film 308 often has a stretch limit between 190% and 275%, depending on the stretch film's resin blend and the type of load being wrapped. Pre-stretching by more than 275% often causes the stretch film 308 to tear. For the present disclosure, the composite stretch film 322 may be pre-stretched beyond 275%. In some implementations, the pre-stretch may be at least 300%, at least 340%, or between 300% and 340%. This increased stretch in the composite stretch film 322 is possible because of the additional strength that the filaments 310 provide to the composite stretch film 322. The increased stretch facilitates securing the palletized load with less stretch film 308 because the stretch film 308 that is used maintains a tighter grip.

Wrapping each of the at least two composite stretch films 322 may occur simultaneously. In other words, both the first composite stretch film 322 and the second composite stretch film 322 may be wrapped around the palletized load at the same time. Thus, it is possible to leave the gap 344 between the first composite stretch film 322 and the second composite stretch film 322 by having the first composite stretch film 322 separated from the second composite stretch film 322, as shown in FIGS. 19 and 21. As mentioned above, the gap 344 may have a width 345 equal to or larger than the first width 328. In some implementations, the gap 344 may have a width 345 equal to or larger than half of the first width 328. The gap 344 increases the air circulation with the palletized load. Thus, the gap 344 may be especially helpful when wrapping produce or other items that require good air circulation. In addition, the gap 344 decreases the amount of stretch film 308 required to secure the palletized load because the gap 344 does not need to be filled in with stretch film 308 to secure the palletized load and decreases the amount of time required to wrap the palletized load because at least two composite stretch films 322 are wrapped around the palletized load at once, thus reducing the number of times the palletized load must be rotated.

Figure 23:
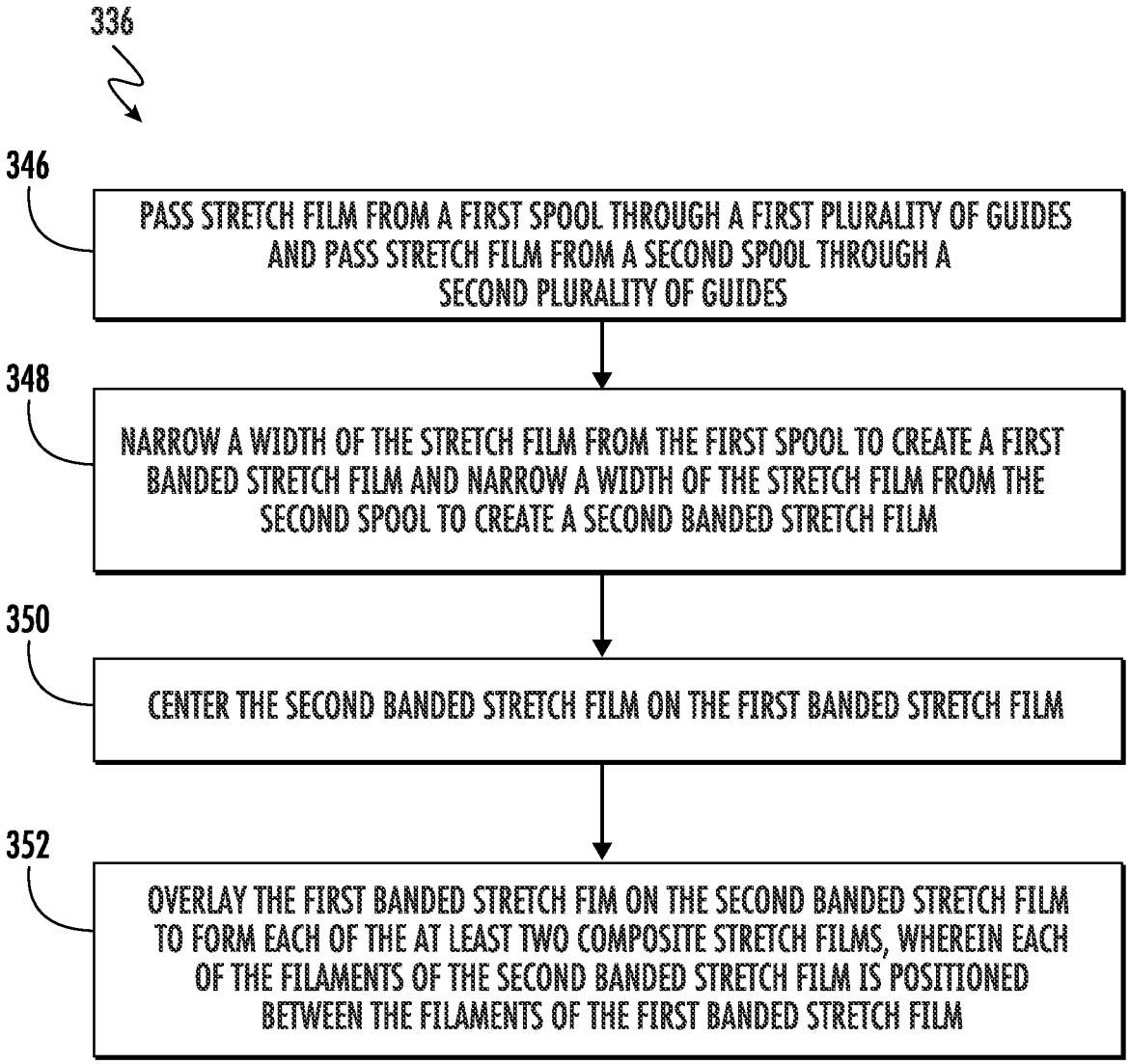
FIG. 23 is a process diagram illustrating the method of forming each of the composite stretch films used to wrap a palletized load using the pallet wrapping system shown in FIG. 19.

As shown in FIG. 23, forming each of the composite stretch films 336 may comprise passing stretch film from the first spool through the first plurality of guides and passing stretch film from the second spool through the second plurality of guides 346, narrowing the width of the stretch film from the first spool to create a first banded stretch film and narrowing the width of the stretch film from the second spool to create a second banded stretch film 348, and overlaying the second banded stretch film on the first banded stretch film to form each of the at least two composite stretch films 352. Forming the at least two composite stretch films may further comprise centering the second banded stretch film on the first banded stretch film 350.

The present disclosure is also related to a pallet wrapping system 400 similar to the pallet wrapping system 100 and the pallet wrapping system 300. Many of the features described above in relation to the pallet wrapping system 100 and to the pallet wrapping system 300 are the same for the pallet wrapping system 400. Thus, components which have similar names or which have similar structures may have similar features, even when not explicitly stated or described. For example, the support bar 102 and the support bar 302 disclosed above may each have any features disclosed below in relation to the support bar 402 and vice versa. Similarly, the adjustment arms 104 and the plurality of guides 304 may have any of the features disclosed below regarding the plurality of guides 404 and vice versa. Any combinations of the features of the pallet wrapping system 100, the pallet wrapping system 300, and the pallet wrapping system 400 are possible and contemplated by this disclosure.

Figure 24:
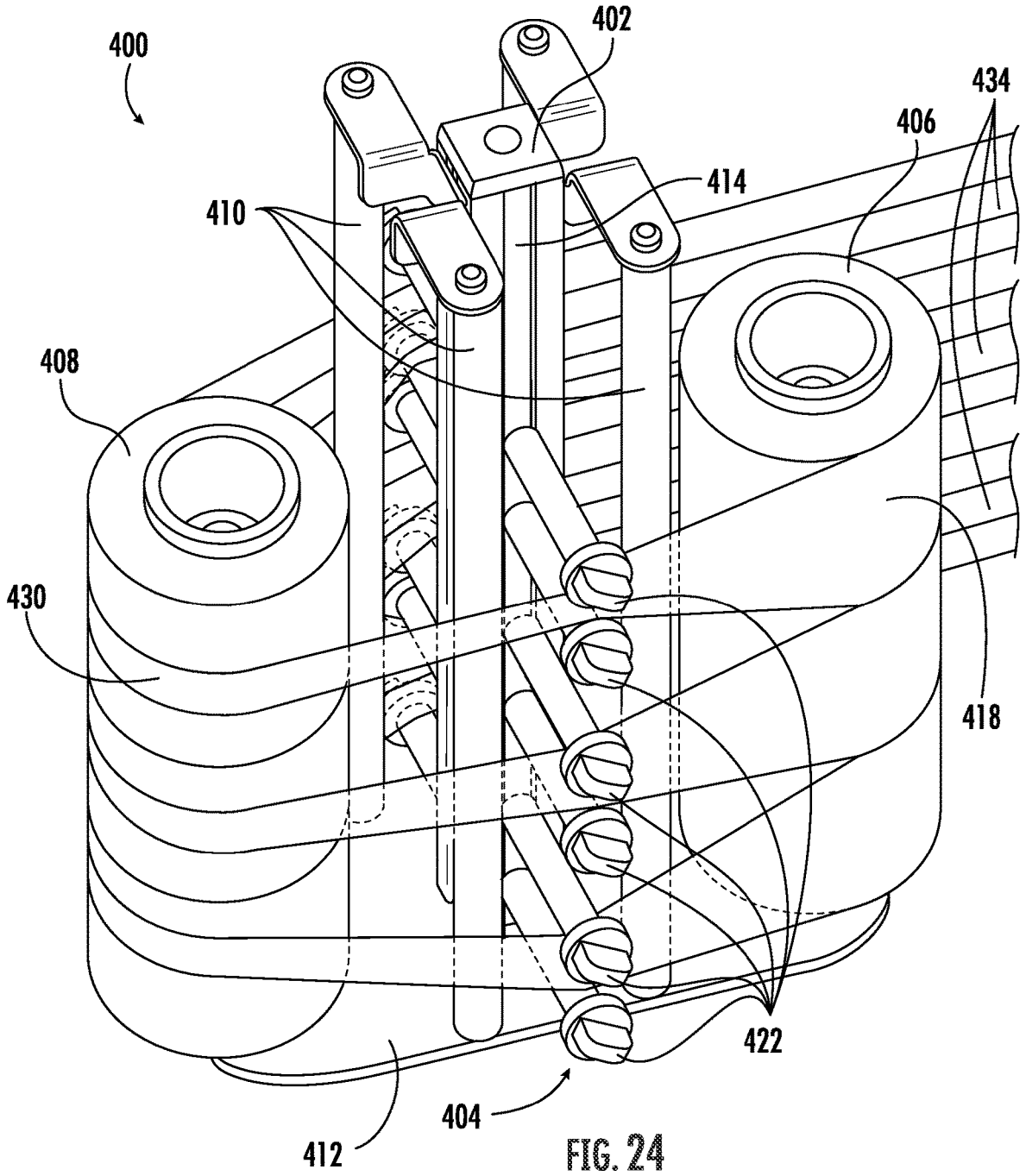
FIG. 24 is a perspective view of another embodiment of the pallet wrapping system.
Figure 25:
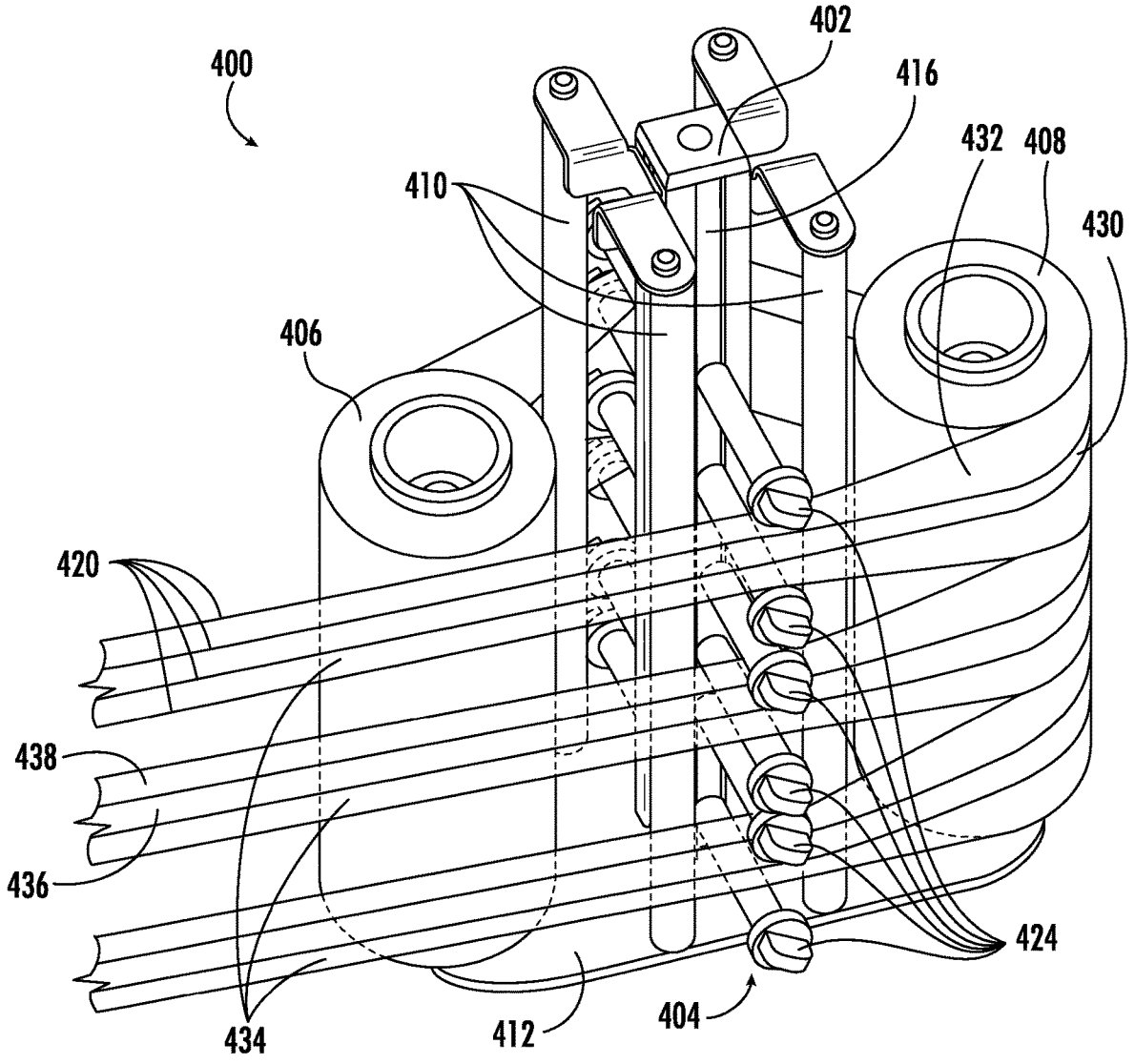
FIG. 25 is another perspective view of the pallet wrapping system shown in FIG. 24 from the opposite side.
Figure 26:
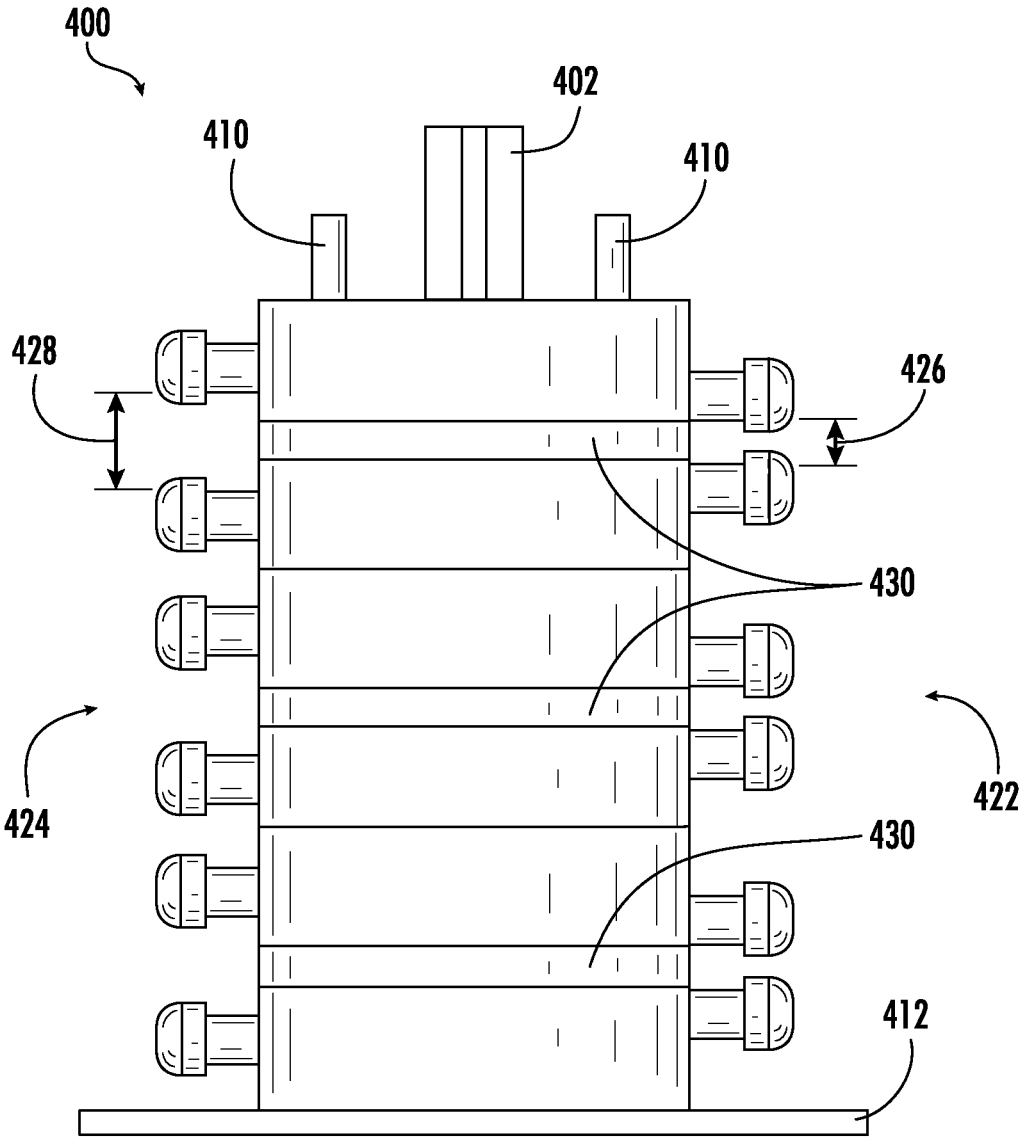
FIG. 26 is a front view of the pallet wrapping system shown in FIG. 24.
Figure 27:
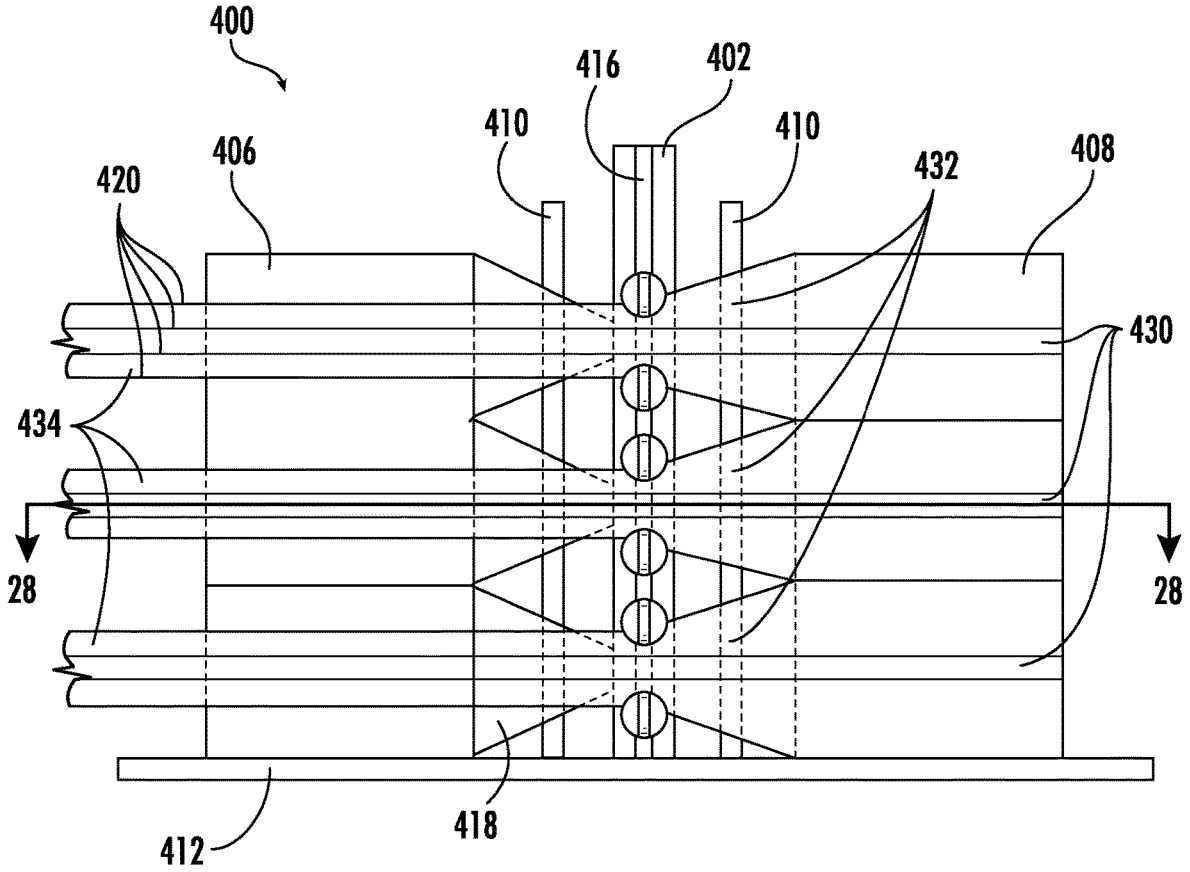
FIG. 27 is a left side view of the pallet wrapping system shown in FIG. 24.

As shown in FIGS. 24 and 25, the pallet wrapping system 400 comprises a support bar 402, a plurality of guides 404, a first roll of stretch film 406, and a second roll of stretch film 408. In some embodiments, the pallet wrapping system 400 also comprises a plurality of rollers 410 extending parallel to the support bar 402. The support bar 402 has a length extending from a base 412 of the pallet wrapping system 400. The length of the support bar 402 may extend vertically from the base 412. The support bar 402 also has a first channel 414 and a second channel 416, each of which extends parallel to the length of the support bar 402. Additional channels may be included in the support bar 402. For example, the support bar 402 may have four channels. Each of the first channel 414 and the second channel 416 may have any of the same features as the channel 108 and/or the channel 306 disclosed above. The first channel 414 and the second channel 416 allow the plurality of guides 404 to slidably couple with the support bar 402 so that the position of each of the plurality of guides 404 along the length of the support bar 402 is adjustable.

The plurality of guides 404 are configured to narrow the width of stretch film 418 as the stretch film 418 passes through the plurality of guides 404. The plurality of guides 404 are also configured to form a banded edge 420 on the stretch film 418. Similar to the filament 310, the banded edge 420 is an edge of the stretch film 418 that has been banded, rolled, folded, bunched together, etc. Rolling the edges of the stretch film 418 gives the stretch film 418 a higher resistance to breaking or tearing compared with stretch film that does not have rolled edges. The plurality of guides 404 comprises a first set of guides 422 and a second set of guides 424. The first set of guides 422 is coupled to the first channel 414 of the support bar 402 and extends away from the support bar 402 in a first direction. The first set of guides 422 may extend perpendicularly away from the support bar 402. As shown in FIG. 3, the first set of guides 422 is configured to narrow the width of the stretch film 418 to a first width 426. The second set of guides 424 is coupled to the second channel 416 of the support bar 402 and extends away from the support bar 402 in a second direction. The second direction may be opposite the first direction. Alternatively, the second direction may be perpendicular to the first direction, or may be some other direction that is neither opposite the first direction or perpendicular to the first direction. The second set of guides 424 may extend perpendicularly away from the support bar 402. As shown in FIG. 3, the second set of guides 424 is configured to narrow the width of the stretch film 418 to a second width 428. The first width 426 may be similar to the second width 330 disclosed above, while the second width 428 may be similar to the first width 328 disclosed above. Specifically, just like the first width 328 may be larger than the second width 330, the second width 428 may be larger than the first width 426. The second width 428 may be between 1.5 inches and 15 inches. In some embodiments, the second width 428 is between 3.5 inches and 5 inches.

As mentioned above, each of the rollers 410 extends parallel to the support bar 402, as shown in FIGS. 24-27. The plurality of rollers 410 is configured to facilitate passing the stretch film 418 through the plurality of guides 404. To that end, a roller 410 may be positioned on either side of the first set of guides 422. As the stretch film 418 is unrolled from the first roll of stretch film 406, the stretch film 418 comes into contact with a roller 410 which is positioned to align the stretch film 418 with the first set of guides 422. Another roller 410 may be located on the other side of the first set of guides 422 to keep the stretch film 418 aligned with the first set of guides 422 and pass the stretch film 418 onto the second roll of stretch film 408. Similarly, a roller 410 may be positioned on either side of the second set of guides 424. As the stretch film 418 is unrolled from the second roll of stretch film 408, the stretch film 418 comes into contact with a roller 410 positioned to align the stretch film 418 with the second set of guides 424. The roller 410 on the other side of the second set of guides 424 is positioned to keep the stretch film 418 aligned with the second set of guides 424 and pass the stretch film 418 on to the pre-stretch carriage.

Figure 28:
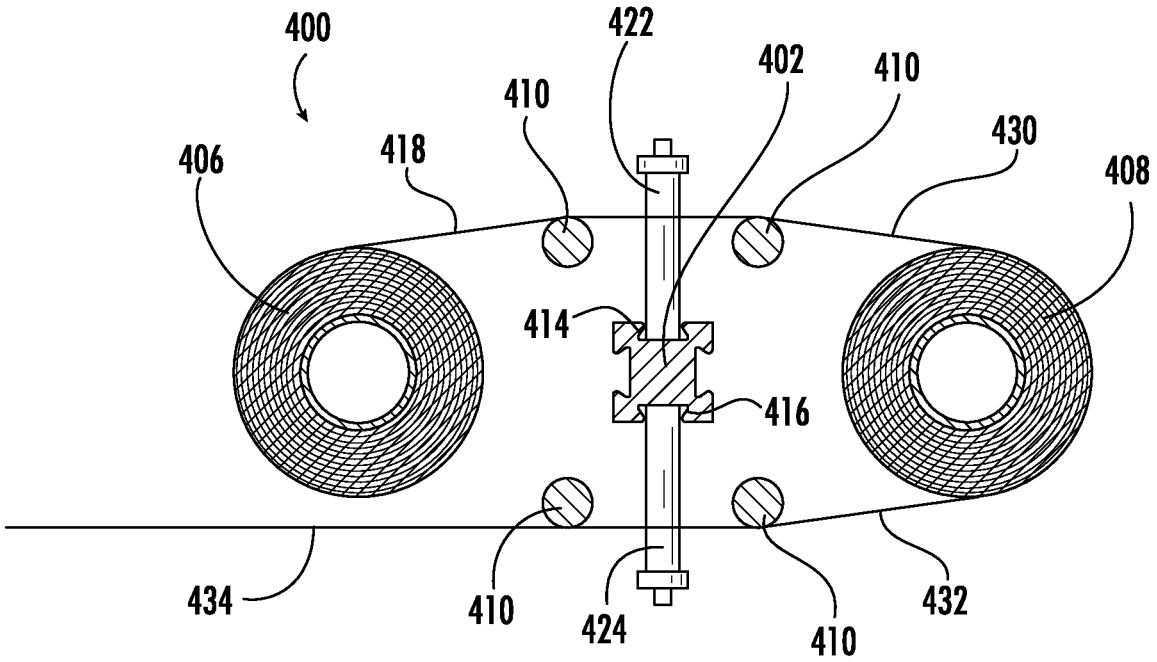
FIG. 28 is a cross section view of the pallet wrapping system taken along line 28-28 in FIG. 27.

The first roll of stretch film 406 is positioned to pass stretch film 418 to the first set of guides 422, as shown in FIG. 28. The second roll of stretch film 408 may be positioned on the opposite side of the support bar 402 from the first roll of stretch film 406 such that the support bar 402 is positioned between the first roll of stretch film 406 and the second roll of stretch film 408. The second roll of stretch film 408 is positioned to receive stretch film 418 from the first set of guides 422. As discussed above, the stretch film leaving the first set of guides 422 is a banded stretch film 430 because the stretch film has been narrowed and banded by the first set of guides 422. The second roll of stretch film 408 is also positioned for the banded stretch film 430 to layer onto the unbanded stretch film 418 of the second roll of stretch film 408, thus forming an unbanded composite stretch film 432, where the central region of the unbanded composite stretch film 432 has two layers of stretch film and is bordered by banded edges, while the two side regions of the unbanded composite stretch film 432 have only one layer of stretch film and do not have banded edges.

The unbanded composite stretch film 432 may be formed before the stretch film coming from the second roll of stretch film 408 has been unwrapped from the second roll of stretch film 408. Thus, the pallet wrapping system 400 may be configured to form the unbanded composite stretch film 432 by layering the banded stretch film 430 onto the second roll of stretch film 408, and then, after the unbanded composite stretch film 432 is formed, the pallet wrapping system 400 may be configured to unwrap the unbanded composite stretch film 432 from the second roll of stretch film 408 to pass the unbanded composite stretch film 432 to the second set of guides 424. Thus, the stretch film 418 from the first roll of stretch film 406 and the stretch film 418 from the second roll of stretch film 408 unwrap from the second roll of stretch film 408 at the same time.

The second roll of stretch film 408 is also positioned to pass the unbanded composite stretch film 432 to the second set of guides 424. When the unbanded composite stretch film 432 passes through the second set of guides 424, the second set of guides 424 narrows the width of the unbanded composite stretch film 432 to the second width 428, thus forming a banded composite stretch film 434. The banded composite stretch film 434 still has a central region with two layers of stretch film and two side regions with one layer of stretch film. However, the banded composite stretch film 434 also has banded edges 420 on the edges of the banded composite stretch film 434. Thus, the banded composite stretch film 434 has a banded first ply 436 and a banded second ply 438. The width of the banded first ply 436 is equal to the first width 426, while the width of the banded second ply 438 is equal to the second width 428.

An advantage of the pallet wrapping system 400 is that the components are contained within a smaller area because of the arrangement disclosed herein. For example, because both the first set of guides 422 and the second set of guides 424 are coupled to the support bar 402, less space is occupied by having multiple support bars 402. Additionally, the path of the stretch film 418 through the pallet wrapping system 400 is contained within a smaller space because the stretch film 418 from the first roll of stretch film 406 wraps around the second roll of stretch film 408. As shown in FIG. 28, the path of the stretch film 408 from the first roll of stretch film 406 may extend around the support bar 402. Additionally, as mentioned above, banding each of the individual stretch films 418 has the effect of strengthening the banded composite stretch film 434 and helps to prevent tearing. Because the banded composite stretch film 434 is stronger, the palletized load wrapped with the banded composite stretch film 434 does not need to be wrapped as many times and may be wrapped at higher tension levels without fear of breaking. Thus, increasing the strength of the wrapping with less stretch film 418 being used per pallet. This leads to savings in time spent wrapping a palletized load, as well as in the amount of stretch film used per load.

It will be understood that implementations of a pallet wrapping system are not limited to the specific assemblies, devices and components disclosed in this document, as virtually any assemblies, devices and components consistent with the intended operation of a pallet wrapping system may be used. Accordingly, for example, although particular pallet wrapping systems, and other assemblies, devices and components are disclosed, such may include any shape, size, style, type, model, version, class, measurement, concentration, material, weight, quantity, and/or the like consistent with the intended operation of pallet wrapping systems. Implementations are not limited to uses of any specific assemblies, devices and components; provided that the assemblies, devices and components selected are consistent with the intended operation of a pallet wrapping system.

Accordingly, the components defining any pallet wrapping system may be formed of any of many different types of materials or combinations thereof that can readily be formed into shaped objects provided that the materials selected are consistent with the intended operation of a pallet wrapping system. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various pallet wrapping systems may be manufactured using conventional procedures as added to and improved upon through the procedures described here. Some components defining a pallet wrapping system may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that methods for manufacturing, assembling, or using pallet wrapping systems are not limited to the specific order of steps as disclosed in this document. Any steps or sequence of steps of the assembly of a pallet wrapping system indicated herein are given as examples of possible steps or sequence of steps and not as limitations, since various assembly processes and sequences of steps may be used to assemble pallet wrapping systems.

The implementations of a pallet wrapping system described are by way of example or explanation and not by way of limitation. Rather, any description relating to the foregoing is for the exemplary purposes of this disclosure, and implementations may also be used with similar results for a variety of other applications employing a pallet wrapping system.

What is claimed is:

1. A pallet wrapping system comprising:

a support bar having a plurality of guides adjustably coupled to the support bar and configured to form a banded edge on stretch film as the stretch film passes through the plurality of guides, wherein the plurality of guides comprises a first set of guides and a second set of guides, the first set of guides configured to narrow a width of the stretch film to a first width, the second set of guides configured to narrow a width of the stretch film to a second width larger than the first width;

a first roll of stretch film positioned to pass stretch film to the first set of guides forming banded stretch film having first and second banded edges on the stretch film from the first roll; and a second roll of stretch film positioned to receive the banded stretch film from the first set of guides, layer the banded stretch film onto unhanded stretch film from the second roll of stretch film to form an unhanded composite stretch film, and then pass the unhanded composite stretch film to the second set of guides to form a banded composite stretch film having a banded first ply with a width equal to the first width and a banded second ply with a width equal to the second width.

2. The pallet wrapping system of claim 1, wherein the support bar has a first channel and a second channel each extending parallel to the support bar, wherein the first set of guides is coupled to the first channel and the second set of guides is coupled to the second channel.

3. The pallet wrapping system of claim 1, wherein each roller of the plurality of rollers is positioned adjacent to the plurality of guides.

4. The pallet wrapping system of claim 1, wherein the pallet wrapping system is configured to form the unbanded composite stretch film by layering the banded stretch film onto the second roll of stretch film and then unwrap the unbanded composite stretch film from the second roll of stretch film to pass the unbanded composite stretch film to the second set of guides.

5. The pallet wrapping system of claim 1, wherein the banded composite stretch film includes the banded stretch film overlapping at least a portion of the unbanded stretch film.

6. The pallet wrapping system of claim 1, further comprising a plurality of rollers extending parallel to the support bar, each roller of the plurality of rollers configured to facilitate passing the stretch film through the plurality of guides.

7. The pallet wrapping system of claim 1, wherein the support bar is positioned between the first roll of stretch film and the second roll of stretch film.

8. The pallet wrapping system of claim 1, further comprising a pre-stretch machine configured to receive and stretch the banded composite stretch film.

9. The pallet wrapping system of claim 1, wherein a path of the stretch film from the first roll of stretch film extends around the support bar.

10. A method of forming a banded composite stretch film, the method comprising:

positioning a first roll of stretch film to pass stretch film to at least a first guide of a plurality of guides adjustably coupled to a support;

forming at least one banded edge on the stretch film as the stretch film passes the at least a first guide to form banded stretch film having a width narrowed to a first width;

positioning a second roll of stretch film to receive the banded stretch film from the at least a first guide;

layering the banded stretch film onto unbanded stretch film from the second roll of stretch film with the at least one banded edge overlapping the unbanded stretch film to form an unbanded composite stretch film;

forming a banded composite stretch film by passing the unbanded composite stretch film to a second set of guides of the plurality of guides to narrow a width of the unbanded composite stretch film to a second width, the banded composite stretch film including a banded first ply and a banded second ply.

11. The method of forming a banded composite stretch film of claim 10, wherein forming the unbanded composite stretch film comprises layering the banded stretch film onto the second roll of stretch film and then unwrapping the unbanded composite stretch film from the second roll of stretch film and passing the unbanded composite stretch film to the second set of guides.

12. The method of forming a banded composite stretch film of claim 10, wherein forming the unbanded composite stretch film comprises overlapping the banded stretch film with at least a portion of the unbanded stretch film.

13. The method of forming a banded composite stretch film of claim 10, wherein positioning the first roll of stretch film and positioning the second roll of stretch film comprises positioning the support between the first roll of stretch film and the second roll of stretch film.

14. The method of forming a banded composite stretch film of claim 10, further comprising receiving and stretching the banded composite stretch film in a pre-stretch machine prior to wrapping a load with the banded composite stretch film.

15. The method of forming a banded composite stretch film of claim 10, further comprising passing the stretch film from the first roll of stretch film around the support bar.

16. A pallet wrapping system comprising:

a support bar having a plurality of guides adjustably coupled to the support bar and configured to form a banded edge on stretch film as the stretch film passes through the plurality of guides, wherein the plurality of guides comprises at least a first guide and a second set of guides, the at least a first guide configured to narrow a width of the stretch film to a first width, the second set of guides configured to narrow a width of the stretch film to a second width;

a first roll of stretch film positioned to pass stretch film to the at least a first guide forming banded stretch film having at least a first banded edge on the stretch film from the first roll; and a second roll of stretch film positioned to receive the banded stretch film from the at least a first guide, layer the banded stretch film onto unbanded stretch film from the second roll of stretch film with the at least a first banded edge overlapping the unbanded stretch film to form an unbanded composite stretch film, and then pass the unbanded composite stretch film to the second set of guides to form a banded composite stretch film having a banded first ply with a width equal to the first width and a banded second ply with a width equal to the second width.

17. The pallet wrapping system of claim 16, wherein the support bar is positioned between the first roll of stretch film and the second roll of stretch film.

18. The pallet wrapping system of claim 16, wherein the pallet wrapping system is configured to form the unbanded composite stretch film by layering the banded stretch film onto the second roll of stretch film and then unwrap the unbanded composite stretch film from the second roll of stretch film to pass the unbanded composite stretch film to the second set of guides.

19. The pallet wrapping system of claim 16, wherein the banded composite stretch film includes the banded stretch film overlapping at least a portion of the unbanded stretch film.

20. The pallet wrapping system of claim 16, further comprising a pre-stretch machine configured to receive and stretch the banded composite stretch film.

* * * * *